US006233993B1

(12) United States Patent
Irie

(10) Patent No.: US 6,233,993 B1
(45) **Date of Patent: *May 22, 2001**

(54) METHOD AND APPARATUS FOR FORMING A PROCESSED PORTION OF A WORKPIECE

(75) Inventor: Tohru Irie, Nagoya (JP)

(73) Assignee: Sango Co., Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/563,345

(22) Filed: May 3, 2000

(30) Foreign Application Priority Data

May 10, 1999 (JP) ..... 11-128515

(51) Int. Cl.[7] ..... B21D 3/02

(52) U.S. Cl. ..... 72/121; 72/82; 72/84; 72/94

(58) Field of Search ..... 72/82, 83, 84, 72/94, 101, 121; 29/890, 890.8

(56) References Cited

U.S. PATENT DOCUMENTS

| | | | | |
|---|---|---|---|---|
| 1,500,261 | | 7/1924 | Page . | |
| 3,340,713 | | 9/1967 | Webb . | |
| 3,477,264 | * | 11/1969 | Sohlemann | 72/81 |
| 3,533,259 | | 10/1970 | Marcouitch . | |
| 4,061,009 | | 12/1977 | Kaporovich . | |
| 4,143,535 | | 3/1979 | Bouman . | |
| 4,563,887 | | 1/1986 | Bressan et al. . | |
| 5,570,603 | | 11/1996 | Chatterly et al. . | |
| 5,758,532 | | 6/1998 | Massee . | |
| 5,901,595 | | 5/1999 | Massee . | |
| 5,937,516 | * | 8/1999 | DeSousa et al. | 29/890 |
| 5,996,386 | * | 12/1999 | Pazzaglia | 72/84 |

FOREIGN PATENT DOCUMENTS

| | | |
|---|---|---|
| B2-54-41271 | 12/1979 | (JP) . |
| U-61-110823 | 7/1986 | (JP) . |
| 3-146232 | 6/1991 | (JP) . |
| 3-226327 | 10/1991 | (JP) . |
| B2-2534530 | 6/1996 | (JP) . |

OTHER PUBLICATIONS

Mathew, P., "Eccentric Metal Spinning–A New Method to Produce Multi–Recessed Parts", Metallurgia and Metal Forming, Dec. 1974, pp. 378–379.

Sereda, V.G., "Calculation of the Energy and Force Parameters in Planetary Rolling of Tubular Blanks," Kuznechno–shatampovochnoe proizvodstvo, 1989, No. 5, pp. 2–4.

* cited by examiner

*Primary Examiner*—Ed Tolan
(74) *Attorney, Agent, or Firm*—Oliff & Berridge PLC

(57) ABSTRACT

A method and apparatus for processing a portion of a workpiece. At least one roller is supported on a rotatable member rotatable about a main axis to be radially moved to and from the main axis. The workpiece is supported so that a central axis of the portion to be processed is aligned with one of a plurality of forming target axes. A plurality of forming target axes are provided on the basis of a plurality of target processed portions of the workpiece changed from the unprocessed portion to a final target changed diameter portion of the workpiece with a central axis thereof being at least one of offset from, oblique to and skewed from a central axis of the unprocessed portion. Then, at least one of the work piece and the roller is driven to be rotated relative to each other about each forming target axis, while the roller is moved radially toward each forming target axis of the plurality of forming target axes, with the roller being in substantial contact with a surface of the portion to be processed. As a result, the portion to be processed is formed into the final target changed diameter portion. Furthermore, opposite end portions of the workpiece may be processed sequentially.

21 Claims, 22 Drawing Sheets

METHOD AND APPARATUS FOR FORMING A PROCESSED PORTION OF A WORKPIECE

BACKGROUND OF THE INVENTION

1. Field of the Invention

The present invention relates to a method for forming a portion of a workpiece, such as a cylinder or shell, and an apparatus therefor, especially the method and apparatus for forming the portion of the workpiece by spinning to form a changed diameter portion of the workpiece, such as a reduced diameter portion of the cylinder.

2. Description of the Related Arts

As for the method for forming a changed diameter portion of a cylindrical member (hereinafter, simply referred to as a cylinder), Japanese Utility-model Laid-open Publication No. 61-110823 discloses a method for forming a cone portion and a body portion by increasing or reducing a diameter of the cylinder to produce a case for holding a catalyst, and reducing a diameter of an open end portion of the case except for the body portion thereof, by a spinning process, to form the other cone portion and a conduit connected thereto in a body. In Japanese Patent Laid-open Publication No. 3-226327, there is disclosed a method for pressing a tubular member longitudinally by a press die to be formed into an approximately conical shape, then rotating the tubular member and pressing a spinning roll onto the outer surface of the portion formed into the conical shape to perform the spinning process, thereby to form an opening portion of a pressure case or the like.

In the mean time, with respect to an outer shell of a catalytic converter or a muffler of an automotive vehicle, it is demanded to produce it easily, and mount it easily in the vehicle, and it is desired to produce it integrally from a metal tube. In this situation, it has been desired to form the reduced diameter portion to be formed on the end portion of the tubular portion, into an unusual shape, such as the one having an offset axis or an oblique axis inclined to a central axis of the cylinder. According to prior methods for forming the cylinder or shell by the spinning process, however, the reduced diameter portion was formed to be coaxial with the main body of the cylinder. In order to produce the cylinder, the main body of which is not coaxial with the reduced portion, therefore, the cone portion (reduced diameter portion) as shown in the right side in FIG. 1 of the above Publication No. 61-110823 was formed by the press working, and then the cone portion was connected to the case body by welding or the like. According to those methods, however, the produced cylinder can not be expected to be so strong, comparing with that of the integral construction. Furthermore, they need the connecting process, different from the forming process, so that it is difficult to produce the cylinder by those methods. As a result, the manufacturing cost of the cylinder shall be increased, comparing with the cylinder of the coaxial type formed by the spinning process.

SUMMARY OF THE INVENTION

Accordingly, it is an object of the present invention to provide a method for forming a changed diameter portion of a workpiece such as a cylindrical member, easily and properly by a spinning process.

It is another object of the present invention to provide an apparatus for forming a changed diameter portion of a workpiece such as a cylindrical member, easily and properly by a spinning process.

In accomplishing the above and other objects, the method for forming the changed diameter portion of the workpiece by spinning may comprise supporting the workpiece so that a central axis of the portion to be processed is aligned with one of a plurality of forming target axes, the plurality of forming target axes being provided on the basis of a plurality of target processed portions of the workpiece changed from the unprocessed portion to a final target processed portion of the workpiece with a central axis of the final target processed portion being at least one of offset from, oblique to and skewed from a central axis of the unprocessed portion, and molding the portion to be processed by a spinning process so that the central axis of the portion to be processed is matched to each forming target axis of the plurality of forming target axes, and simultaneously changing the diameter of the portion to be processed, in each forming target axis.

The apparatus for forming the changed diameter portion of the workpiece may comprise devices for performing the steps as described above. For example, the apparatus may include a rotatable member rotatable about a main axis, and at least one roller operatively mounted on the rotatable member to be radially movable to and from the main axis, and in contact with a surface of the portion to be processed. In the apparatus, a first driving device may be provided for moving at least one of the workpiece and the at least one roller relative to each other so that a central axis of the portion to be processed is aligned with one of a plurality of forming target axes, the plurality of forming target axes being provided on the basis of a plurality of target processed portions of the workpiece changed from the unprocessed portion of the workpiece to a final target changed diameter portion of the workpiece with a central axis of the final target processed portion being at least one of offset from, oblique to and skewed from a central axis of the unprocessed portion. A second driving device may be provided for moving the at least one roller radially toward each forming target axis of the plurality of forming target axes, with the at least one roller being in substantial contact with the surface of the portion to be processed and rotating the at least one roller about the main axis relative to the workpiece. A controller controls the first and second driving means to form the portion to be processed into the final target changed diameter portion.

According to the method and apparatus as described above, the changed diameter portion may be formed to provide a tapered portion, with the diameter of the workpiece gradually changed from an unprocessed portion of the workpiece toward an end of the changed diameter portion. The changed diameter portion may be formed to provide the tapered portion and a neck portion of a tubular configuration extending from the tapered portion.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Referring to FIGS. 1–4, there is schematically illustrated a spinning apparatus according to an embodiment of the present invention, to produce finished products, such as an outer shell (not shown) of a muffler for an automobile, a case (not shown) of a catalytic converter, and various pressure cases. The cylinder to be formed according to the present embodiment is the one made of stainless steel, while it is not limited to this, and may be selected from other metallic cylinders. In FIGS. 1–4, the spinning apparatus according to the present embodiment includes a first driving mechanism 1 and a second driving mechanism 2, both of which are operatively mounted on a base BS.

Figure 2:
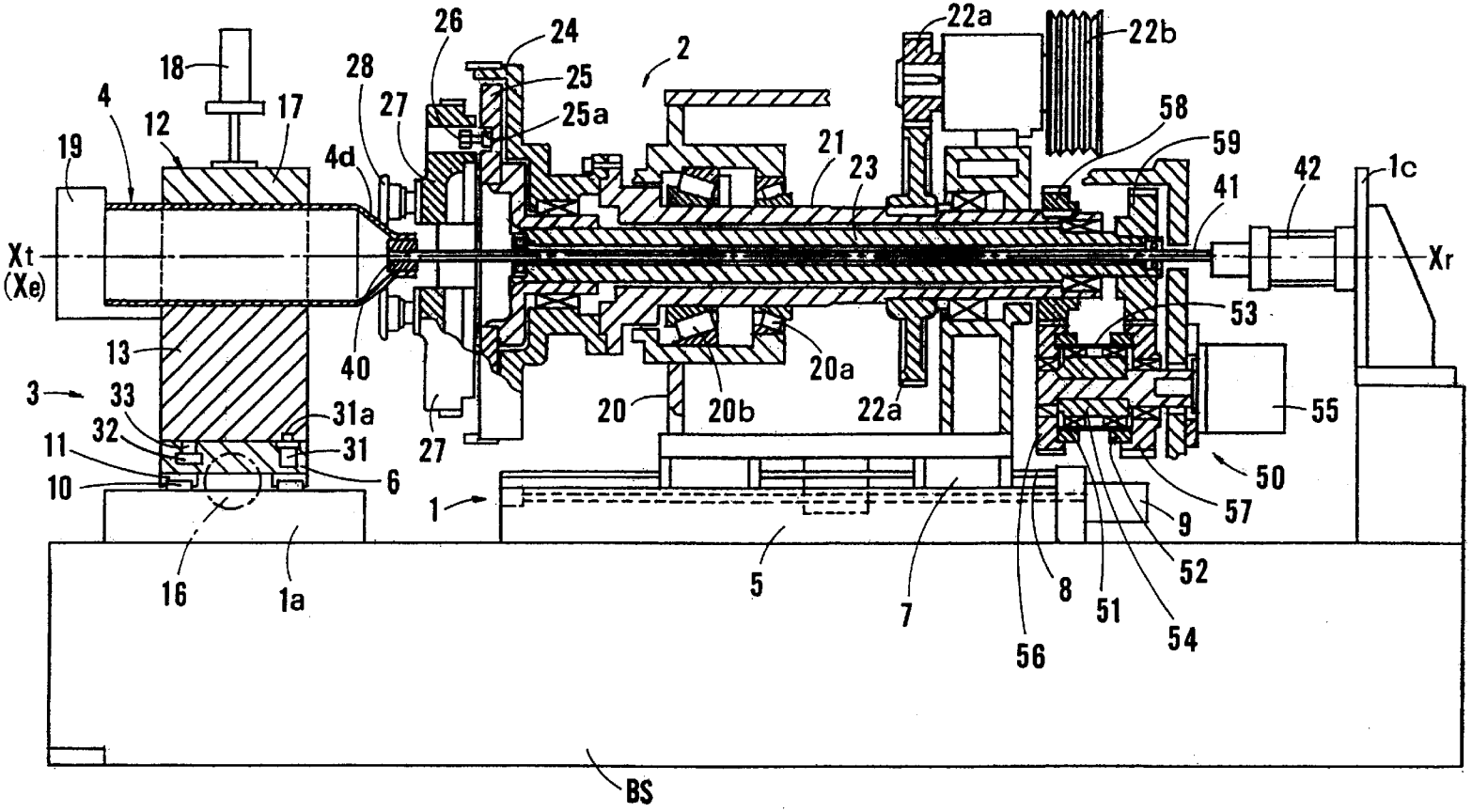
FIG. 2 is a side view of a spinning apparatus with a portion thereof sectioned according to an embodiment of the present invention.
Figure 3:
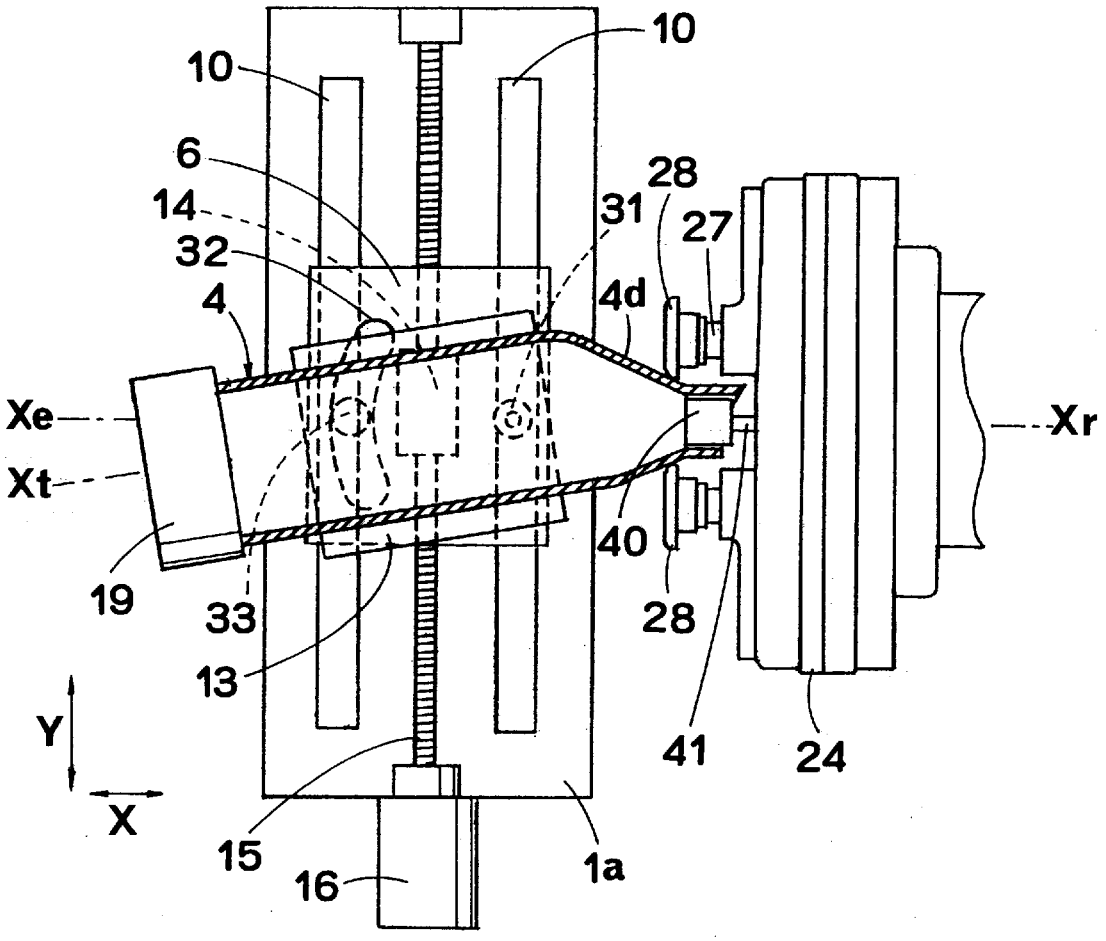
FIG. 3 is a plan view of a spinning apparatus with a portion thereof sectioned according to an embodiment of the present invention.

In the first driving mechanism 1, a central axis Xt of a cylindrical member 4 (i.e., cylinder) is employed as a forming target central axis Xe of an end portion (i.e., the forming target central axis Xe of the cylinder 4 is aligned with the central axis Xt, because they are on the same plane in FIG. 2), in parallel with which a pair of X-axis guide rails 5 are fixedly secured to one side (right side in FIG. 2) on the base BS. A case 20 is arranged to be movable along the X-axis guide rails 5. The case 20 has a ball socket 7 which is secured under the case 20, and which is engaged with a spline shaft 8. This shaft 8 is mounted on the base BS in parallel with the X-axis guide rails 5, to be rotated by a servo motor 9. Accordingly, when the spline shaft 8 is rotated by the servo motor 9, the case 20 is moved along the X-axis. On the other hand, a bed 1*a* is formed on the other side (left side in FIG. 2) of the base BS. Fixedly secured to the bed 1*a* are a pair of Y-axis guide rails 10, on which a pair of sliders 11 for supporting a sliding table 6 and a clamp device 12 are movably mounted, respectively. The clamp device 12 includes a lower clamp 13 rotatably mounted on the table 6, and an upper clamp 17 arranged upward of the lower clamp 13, to clamp the cylinder 4 between the lower clamp 13 and upper clamp 17. The table 6 has a ball socket 14 (as shown in FIG. 3) secured thereunder, which is engaged with a spline shaft 15. This shaft 15 is mounted on the bed 1*a* in parallel with the Y-axis guide rails 10, to be rotated by a servo motor 16. When the spline shaft 15 is rotated by the motor 16, the table 6 and clamp device 12 are moved along the Y-axis relative to the case 20.

Above the clamp device 17, an actuator 18, which is activated by oil pressure, for example, is arranged to support the upper clamp 17 and drive it vertically. When the cylinder 4 is set on or removed from the clamp device 12, the upper clamp 17 is lifted by the actuator 18 upward. A clamp face of a half cylinder configuration is formed on the upper surface of the lower clamp 13, and a clamp face of a half cylinder configuration is formed on the lower surface of the upper clamp 17. Therefore, when the cylinder 4 is clamped between the clamp faces, it is secured not to be rotated or moved. On the clamp device 12, a stopper 19 is disposed at the opposite side to the case 20, to abut on a one end portion of the cylinder 4. The stopper 19 is secured to the lower clamp 13, so as to be movable together with the clamp device 12. If the stopper 19 is connected to the lower clamp 13 to be adjustable along the central axis Xt of the cylinder 4, positioning of the cylinder 4 in its axial direction can be made properly and easily. Accordingly, when the cylinder 4 is set on the clamp face of the lower clamp 13, with the one end portion of the cylinder 4 abutted on the stopper 19, and then the upper clamp 17 is actuated to move downward by the actuator 18, the cylinder 4 is clamped at a predetermined position between the lower clamp 13 and upper clamp 17. In this case, the cylinder 4 is positioned such that its central axis Xt is located on the same plane as the plane where the longitudinal central axis Xr of a main shaft 21, which will be described later, is located in parallel with the base BS, i.e., on the same height from the base BS as the height of the central axis Xr from the base BS.

Figure 1:
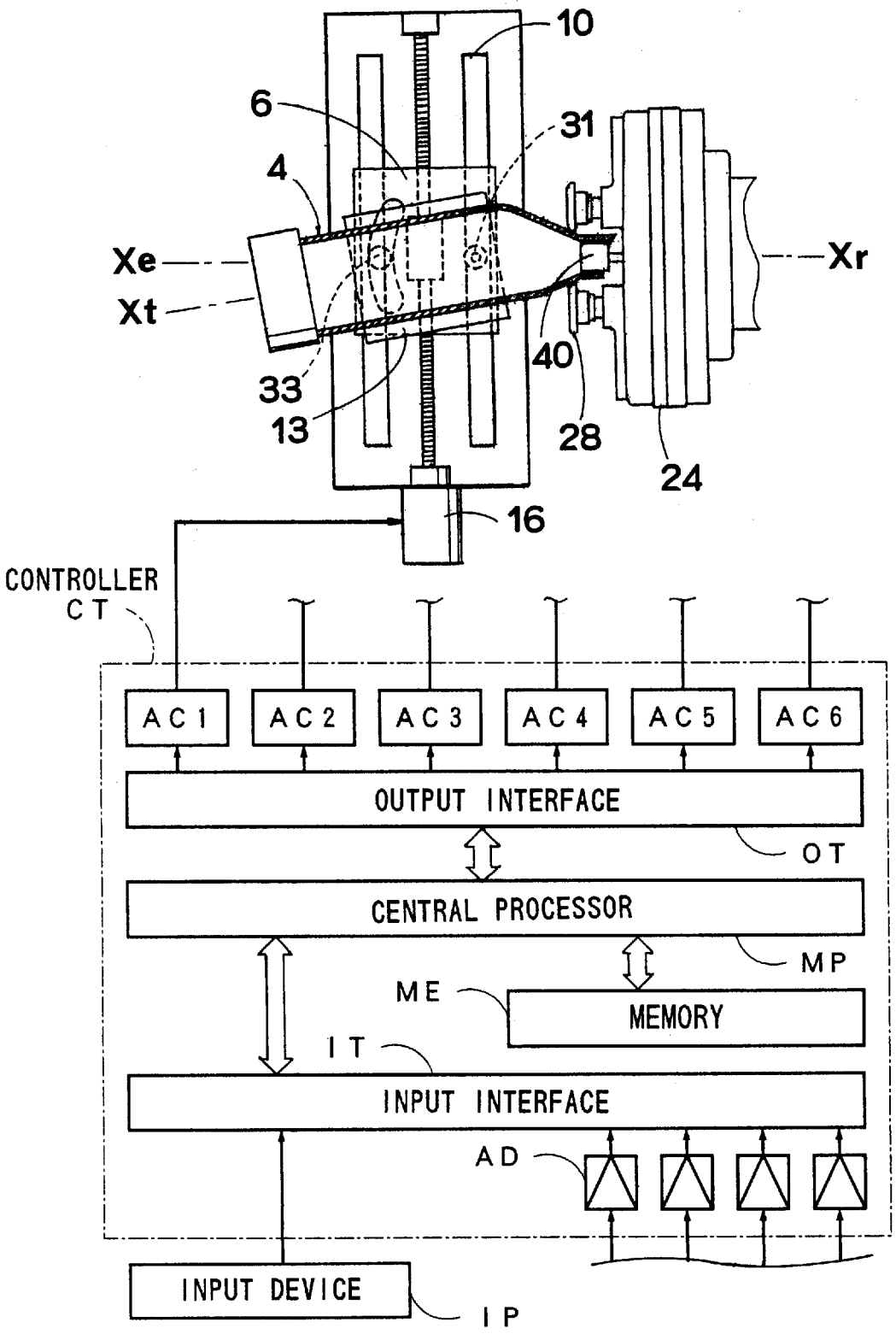
FIG. 1 is a schematic block diagram illustrating a spinning apparatus according to an embodiment of the present invention.

A rotating device such as a motor 31 is embedded in the table 6 at the left side in FIG. 2, and an output shaft 31*a* of the motor 31 extends upward in FIG. 1, or perpendicularly to-the base BS, to be engaged with the lower clamp 13, which is rotated about the shaft 31*a*. On the upper surface of the table 6, there is formed a guide groove 32 which has a circular configuration with its center located on the shaft 31*a*, and into which a guide roller 33 is fitted. The guide roller 33 is rotatably mounted on the lower clamp 13, so that the lower clamp 13 is guided by the groove 32 to be rotated about the shaft 31*a*.

Figure 4:
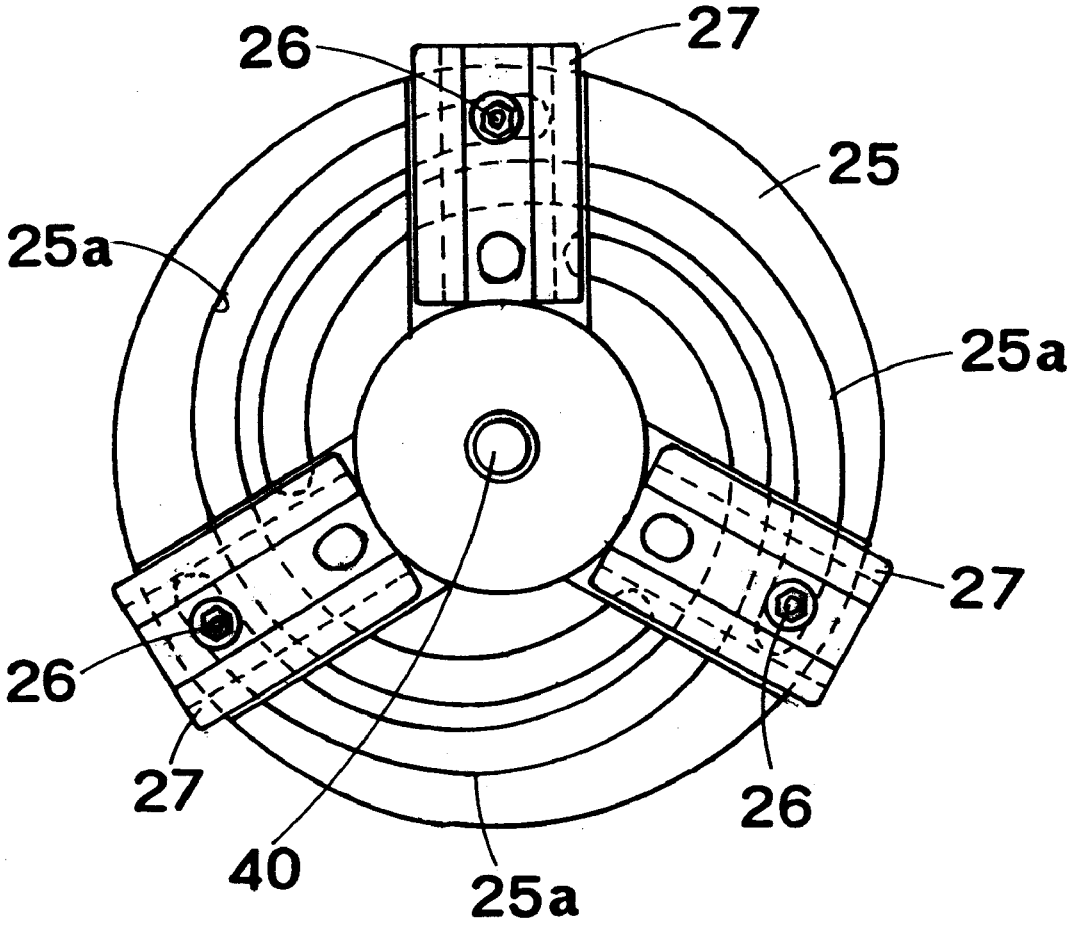
FIG. 4 is a front view showing a cam plate and support members section according to an embodiment of the present invention.

With respect to the second driving mechanism 2, the main shaft 21 is positioned on the same plane as the plane, on which the central axis Xt of the cylinder 4 is located, and which is parallel with the base BS. The main shaft 21 is placed on approximately the same axis as the forming target central axis Xe of the cylinder 4 to be opposite to the cylinder 4, and mounted on the case 20 through bearings 20*a*, 20*b* to be rotated about the central axis Xr. The main shaft 21 is a hollow cylindrical member, in which a cylindrical cam shaft 23 is received, and which is connected to a changing speed mechanism 50 as described later. Through a hollow portion of the cam shaft 23, a connecting rod 41 of a mandrel 40 is mounted to be movable in the axial direction of the cam shaft 23. The mandrel 40 is formed to be fitted into the inner shape of the open end portion of the cylinder 4. The connecting rod 41 is connected at its end to a cylinder 42 for driving it to move back and forth, and the cylinder 42 is mounted on the base BS through a bracket 1*c*. The main shaft 21 is connected through a gear train 22*a* to a pulley 22*b*, which is further connected to a rotating device such as a motor (not shown) through a belt (not shown), so as to rotate the main shaft 21. A flange 24 is fixed to a tip end of the main shaft 21, so that the flange 24 is rotated about the central axis Xr, together with the main shaft 21, when the latter is rotated. The cam shaft 23 is rotatably mounted on the flange 24. A cam plate 25 is fixed to a tip end portion of the cam shaft 23, and rotated about the central axis Xr together with the cam shaft 23. As shown in FIG. 4, the cam plate 25 is formed with three spiral guide grooves 25*a*, in which three guide pins 26 are disposed, respectively, to be moved in a radial direction in accordance with rotation of the cam plate 25. The guide pins 26 are mounted on three support members 27, respectively, and the roller 28 is rotatably mounted on each support member 27, as shown in FIGS. 2 and 3. When the main shaft 21 is rotated, therefore, the roller 28 is rotated about the central axis Xr, and at the same time the support members 27 are moved in a radial direction in accordance with rotation of the cam plate 25, so that the roller 28 is moved toward and away from the central axis Xr of the cylinder 4.

The speed changing mechanism 50 connected to the cam shaft 23 is the one employing a flexibly engaged driving system that includes a pair of outer rings 51, 52, which are engaged with the main shaft 21 and the cam shaft 23, respectively, and inner surfaces of which are formed with gears of the same number of teeth. The flexibly engaged driving system further includes a flexible gear wheel 53, which is formed with different number of teeth from the gears of the outer rings 51, 52, and which is engaged with the outer rings 51, 52, and includes a wave forming wheel 54, which is arranged to support the gear wheel 53 to be rotated, and which is arranged to engage with the gears of the outer rings 51, 52 at the two positions facing each other. The wave forming wheel 54 is rotated by a decelerating motor 55. The outer rings 51, 52 are mounted on support gears 56, 57, respectively. A driving gear 58 engaged with the support gear 56 is mounted on the main shaft 21, and a driven gear 59 engaged with the support gear 57 is mounted on the cam shaft 23. The flexibly engaged driving system is already known as a Harmonic Drive (TM of Harmonic Drive Systems, Inc., http://www.hds.co.jp/hdss.htm) for example, explanation of its principle will be omitted. The system in the present embodiment provides a differential mechanism which causes a relative speed difference between the outer rings 51 and 52 in accordance with rotation of the main shaft 21. Accordingly, when the main shaft 21 is rotated, the cam shaft 23 is rotated by the differential rotation between the outer rings 51, 52, thereby to rotate the cam plate 25, so that each support member 27 and each roller 28 together therewith are moved in a radial direction toward and away from the central axis Xr of the main shaft 21. The roller 28 may be provided only one, but it is preferable to provide a plurality of rollers, so as to reduce intermittent impacts, and it is ideal to provide three rollers 28 as in the present embodiment. Any course may be traced by the roller 28 as long as the roller 28 can be moved in a radial direction. As a further embodiment of the device for driving the roller 28, may be employed a planetary gear mechanism (not shown herein), or other devices.

The motors 9, 16, 31 or the like and the actuator 18 or the like are electrically connected to a controller CT as shown in FIG. 1, from which control signals are output to the motors and actuators to control them numerically. The controller CT includes a central processor MP, memory ME, input interface IT and output interface OT, which are connected with each other through a bass bar, as shown in FIG. 1. The central processor MP is adapted to execute a program for spinning process according to the present embodiment, and the memory ME is adapted to memorize the program and temporarily memorize variable data needed to execute the program. An input device IP is connected to the input interface IT to input initial conditions, operating conditions or the like of the motors and actuators into the central processor MP, e.g., by operating a key board or the like manually. There are provided various sensors (not shown), if necessary, and signals detected by those sensors are fed to the controller CT, wherein the signals are input from the input interface IT to the central processor MP through amplifying circuits AD or the like. The control signals are output from the output interface OT and fed into the motors 9, 16, 31, 55 and the actuator 18 or the like, through driving circuits AC1 or the like. Instead of the controller CT, a control circuit may be provided for each device to perform a predetermined individual control, respectively.

Figure 5:
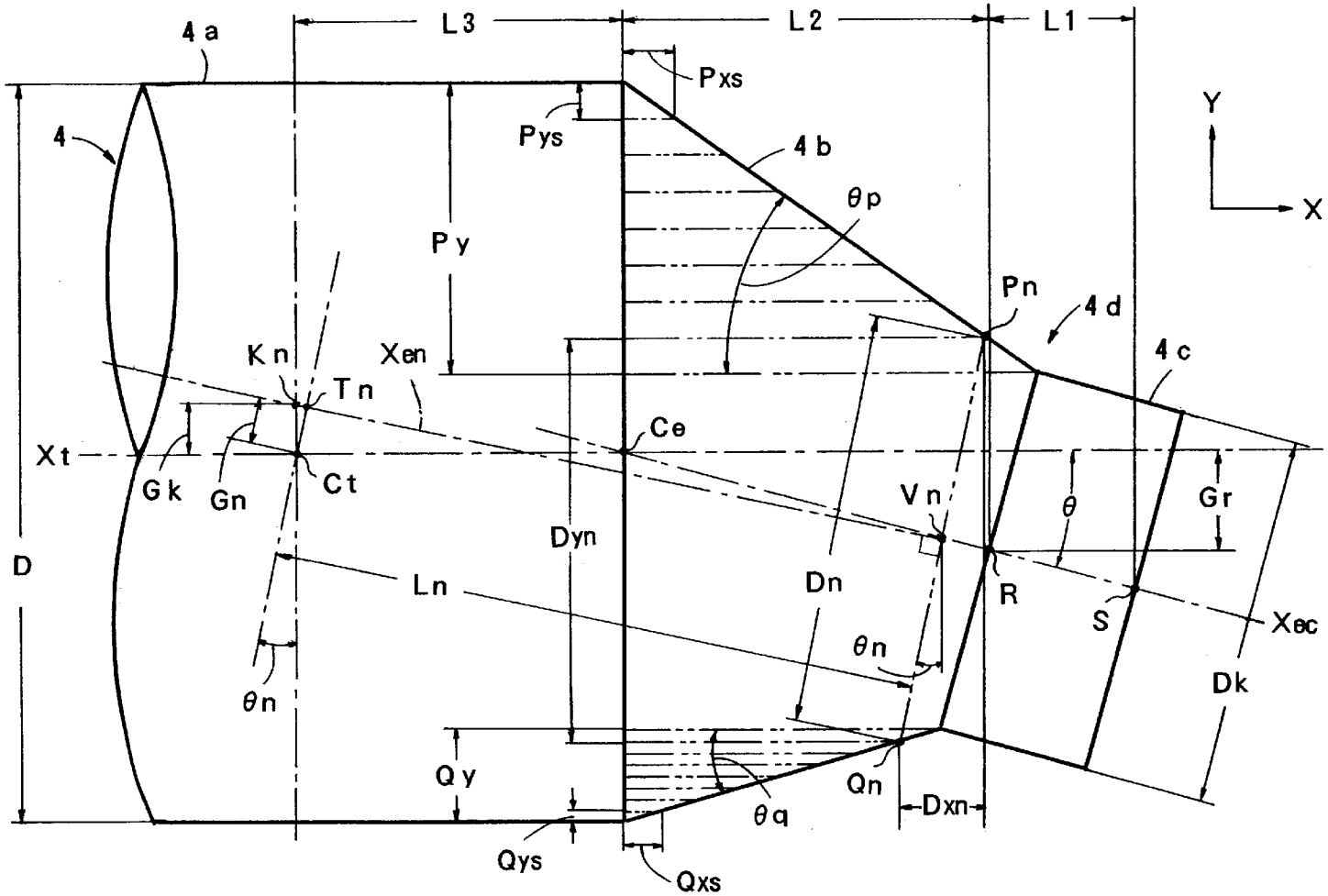
FIG. 5 is a schematic view of a cylinder showing an example of reducing a diameter of a cylinder about a forming target axis by a spinning apparatus according to an embodiment of the present invention.

Referring to FIG. 5, will be explained hereinafter an embodiment of the method for reducing the diameter of the end portion of the cylinder by the above-described spinning apparatus. In FIG. 5, a thick solid line indicates an estimated configuration of a finished cylinder 4, i.e., a configuration of its final forming target end portion, which includes a body portion 4*a*, and a tapered portion 4*b* and a neck portion 4*c* which constitute a reduced diameter portion 4*d*. "Ct" indicates a rotational center, about which the cylinder 4 is rotated, and on which the shaft 31*a* of the clamp device 12 is located. "Ce" indicates a center, from which forming operation to the end portion of the cylinder 4 begins, and which is lying on the central axis Xt of the cylinder 4, together with the rotational center Ct. "S" indicates the center of the final forming target of the neck portion 4*c*, and "R" indicates the center of the smallest diameter section of the final forming target of the tapered portion 4*b*, and at the same time the center of a plane mating with the neck portion 4*c*. "L1" indicates a distance between "S" and "R" (abbreviated as a distance S-R) along the X-axis, "L2" indicates a distance R-Ce along the X-axis, and "L3" indicates a distance Ce-Ct along the X-axis. An axis including the centers "S" and "R" is a forming target central axis Xec. A final oblique angle of "θ" is formed between the forming target central axis Xec and the central axis Xt of the cylinder 4. And, "Gr" indicates a final offset amount, which is a distance between the center "R" and the central axis Xt of the cylinder 4. Although the center Ce where the forming begins is lying on the forming target central axis Xec in FIG. 5, the central axis Xec does not necessarily include the center Ce, so that the center Ce will be apart from the central axis Xec when the final oblique angle θ is set to be larger than that as shown in FIG. 5.

In FIG. 5, "D" indicates a diameter of the body portion 4*a* of the cylinder 4, and "Dk" indicates the smallest diameter of the forming target tapered portion 4*b*, and at the same time the diameter of the forming target neck portion 4*c*. "Py" indicates a distance along the Y-axis on the X-Y plane (i.e., in the radial direction), which corresponds to the amount to be reduced at a portion which is to be formed to a relatively large extent as shown in the upper side of FIG. 5. Whereas, "Qy" indicates a distance along the Y-axis, which corresponds to the amount to be reduced at a portion which is to be formed to a relatively small extent as shown in the lower side of FIG. 5. When the tapered portion 4*b* is formed, the distances Py and Qy to be reduced are divided by a predetermined number "N" (eight in FIG. 5) of forming cycles. The moving distances along the Y-axis per one cycle, i.e., pitches along the Y-axis are indicated by "Pys" and "Qys", and the moving distances along the X-axis per one cycle, i.e., pitches along the X-axis are indicated by "Pxs" and "Qxs". "θp" indicates an angle formed on the X-Y plane between the central axis Xt and a longitudinal contour of the final forming target configuration of the end portion formed to a relatively large extent, i.e., a relatively large angle, whereas "θq" indicates an angle between the central axis Xt and a longitudinal contour of the final forming target configuration formed to a relatively small extent, i.e., a relatively small angle.

On the X-Y plane, the diameter of the forming target end portion at the cycle of (n) for forming the tapered portion 4*b* is indicated by two-dot chain lines, and a point of intersection between that diameter and the longitudinal contour of the final forming target configuration of the end portion formed to a relatively large extent (upper portion in FIG. 5) is indicated by "Pn", and a point of intersection between that diameter and the longitudinal contour of the final forming target configuration of the end portion formed to a relatively small extent is indicated by "Qn" (lower portion in FIG. 5). "Vn" indicates a middle point of a line segment between the points Pn and Qn. An axis Xen including the middle point Vn and perpendicular to the Pn-Qn line segment is set for a forming target central axis. Therefore, a plurality of forming target central axes Xen (n=1–8) are set in accordance with positions of the points Pn and Qn. "Dn" indicates a distance between the points Pn and Qn, which is twice the moving distance of each roller moved in the radial direction, with its component on the X-axis indicated by "Dxn", and with its component on the Y-axis indicated by "Dyn". And, "θn" indicates an angle formed between a vertical axis and the line segment between the points Pn and Qn as indicated by a two-dot chain line. The forming target central axes Xen (n=1–8) and the forming target central axis Xec are indicated by a forming target central axis Xe.

Accordingly, the distance Py to be reduced is calculated according to the following formula (1).

$$Py=D/2+Gr-(Dk/2)\cdot\cos\theta \tag{1}$$

Also, the distance Py to be reduced is calculated according to the following formula (2).

$$Qy=D/2-Gr-(Dk/2)\cdot\cos\theta \tag{2}$$

The angles θp, θq are calculated according to the following formulas (3) and (4).

$$\tan(\theta p)=Py/\{L2+(Dk/2)\cdot\sin\theta\} \tag{3}$$

$$\tan(\theta q)=Qy/\{L2-(Dk/2)\cdot\sin\theta\} \tag{4}$$

When the spinning process is performed N-cycles, the Y-axis components Pys and Qys of the moving distance per one cycle (i.e., pitch) are Py/N and Qy/N, respectively. And, the X-axis components Pxs and Qxs can be obtained by Pys/tan(θp) and Qys/tan(θq), respectively. The X-axis component Dxn and the Y-axis component Dyn of the distance Dn between the points Pn and Qn at (n) cycle can be obtained as follows:

$$Dxn=(Pxs-Qxs)\cdot n$$

$$Dyn=D-(Pys+Qys)\cdot n$$

The distance Dn between the points Pn and Qn is obtained as follows:

$$Dn=Dyn/\cos(\theta n)$$

Therefore, (θn) can be obtained as follows:

$$\tan(\theta n)=Dxn/Dyn$$

Provided that the coordinate system having a x-axis and a y-axis in parallel with the X-axis and Y-axis, with its origin (0,0) positioned on the center Ce for beginning the forming process, the x-axis component Vxn and the y-axis component Vyn of the middle point Vn between the points Pn and Qn can be calculated according to the following formulas (5) and (6).

$$Vxn=(Pxs+Qxs)\cdot n/2 \tag{5}$$

$$Vyn=-D/2+Dyn/2+Qys\cdot n \tag{6}$$

On the coordinate system with the x-axis and y-axis, a line which is perpendicular to the line segment Pn-Qn and which is lying on the middle point Vn, i.e., the forming target central axis Xen, is indicated by [y=a·x+b]. Since the gradient (a) of the line is (−Dxn/Dyn), and the line is lying on the point Vn, i.e., the coordinate (Vxn, Vyn), the value "b" can be calculated according to the following formula (7).

$$b=Vyn+(Dxn/Dyn)\cdot Vxn=-D/2+Dyn/2+Qys\cdot n+(Dxn/Dyn)\cdot(Pxs+Qxs)\cdot n/2 \quad (7)$$

As a result, the line which is perpendicularly to the line segment Pn-Qn and which includes the middle point Vn, i.e., the forming target central axis Xen, can be indicated by the following formula (8).

$$y=(-Dxn/Dyn)\cdot x+(Dxn/Dyn)\cdot(Pxs+Qxs)\cdot n/2-D/2+Dyn/2+Qys\cdot n \quad (8)$$

An intersection Kn between the above-described line (forming target central axis Xen) and a line which is perpendicular to the central axis Xt and which is lying on the rotational center Ct, has (−L3) of its x-coordinate (the origin is Ce), so that the y-coordinate of the intersection Kn corresponds to a distance Gk between the rotational center Ct and the intersection Kn, and it can be indicated by the following formula (9).

$$Gk=(Dxn/Dyn)\cdot L3+(Dxn/Dyn)\cdot(Pxs+Qxs)\cdot n/2-D/2+Dyn/2+Qys\cdot n \quad (9)$$

Then, a distance Gn between the rotational center Ct and an intersection Tn between the line which is perpendicular to the line segment Pn-Qn and which is lying on the middle point Vn (i.e., the forming target central axis Xen) and a line which is parallel with the line segment Pn-Qn and which is lying on the rotational center Ct, can be obtained by Gk·cos θn. And, a distance Ln between the points Vn and Tn can be obtained according to the following formula (10).

$$Ln=\{(Vxn+L3)/\cos(\theta n)\}-Gk\cdot\sin(\theta n) \quad (10)$$

In the case where a tapered portion including the points Pn and Qn is formed, therefore, if the cylinder 4 is rotated about the rotational center Ct counter-clockwise by the angle θn in FIG. 5, the forming target central axis Xen will be positioned in parallel with the central axis Xr (shown in FIGS. 2 and 3) of the main shaft 21, which is aligned with the central axis Xt of the cylinder 4 at the initial position. Furthermore, if it is moved in parallel by the distance Gn along the Y-axis (upward in FIG. 5), it will be aligned with the central axis Xr of the main shaft 21. Thus, provided that the forming target central axis Xen is set as mentioned above, that the moving distance of the roller in the radial direction is set to be Dn/2, and that the distance from the rotational center Ct is set to be Ln, then the tapered portion including the points Pn and Qn can be formed by the spinning process properly.

According to the present embodiment, the final forming target configuration is set in advance, and each forming target configuration for each cycle of N cycles (eight cycles in this embodiment) is also set in advance. Then, the distances Ln, Gn for each forming target configuration are calculated, and the forming target central axes Xen (n=1–8) and Xec are set on the basis of the calculated results, in advance. On the basis of the forming target central axes Xen, Xec, the spinning process is performed in accordance with a sequence of the cycles beginning from the first forming cycle. By calculating them N-times, therefore, obtained are Dn=Dk, θn=θ, Ln=L2/cos θ+L3·cos θ, and Gn=L3·sin θ, so that the tapered portion 4*b* will be formed. The forming target central axis Xen obtained at the eighth forming cycle (n=8), i.e., the axis Xe8 is overlapped with the forming target central axis Xec of the neck portion 4*c*, around which the spinning process is performed, thereby to form the neck portion 4*c*.

In the present embodiment, the amount to be formed per one cycle is set to be equal as shown in FIG. 5, whereas it may be set to be changed in accordance with a required forming process. For example, the moving amount between each cycle and the following cycle may be enlarged at an initial stage of the forming process to shorten the forming time, or the moving amount between each cycle and the following cycle may be shortened at a final stage of the forming process to improve accuracy of the finished product. The number (N) of forming cycles is to be set appropriately, such that the amount to be formed per one cycle never exceeds a limit for reducing the diameter of the cylinder 4, beyond which a plastic working will not be performed properly due to a material property of the cylinder 4, otherwise (if the process for reducing the diameter is made beyond the limit), a wall of the product will be formed to be thin, or even damaged.

Figure 6:
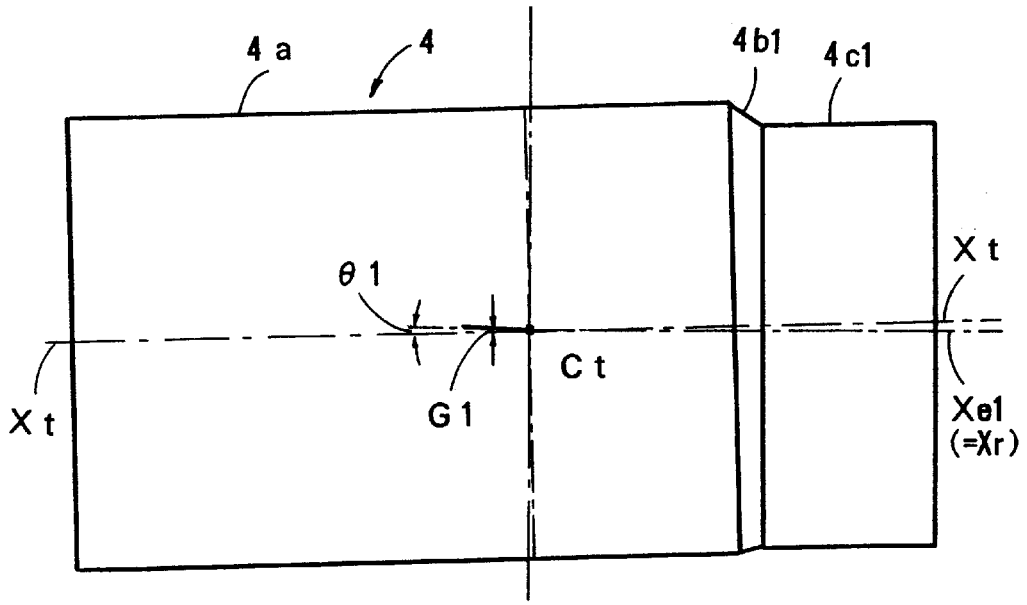
FIG. 6 is a front view of a cylinder showing an end portion thereof in each process, with a diameter thereof reduced about a forming target axis by a spinning apparatus according to an embodiment of the present invention.

In operation, referring to FIG. 2, when the upper clamp 17 of the clamp device 12 is lifted upward, the cylinder 4 to be formed is placed on the clamp face of the lower clamp 13, and set at the predetermined position where the one end portion of the cylinder 4 is abutted on the stopper 19. Then, the actuator 18 is driven, so that the upper clamp 17 is moved downward, and the cylinder 4 is clamped between the lower clamp 13 and upper clamp 17, and held not to be rotated. In this case, the cylinder 4 is positioned such that the central axis Xt of the cylinder 4 is aligned with the central axis Xr of the main shaft 21, to be placed in a different state from that as shown in FIG. 3. Each roller 28 is retracted outside of the outer periphery of the cylinder 4. Next, the case 20 is moved forward along the X-axis guide rail 5, i.e., leftward in FIGS. 2 and 3, and stopped at a position where each roller 28 is placed at the position away from the center of the shaft 31*a* of the clamp device 12, i.e., the rotational center Ct as shown in FIG. 5, by the distance L3. In the first forming cycle (n=1), the forming target central axis Xe1 is employed as shown in FIG. 6, and the clamp device 12 is rotated by the angle θ1, and moved along the Y-axis by the distance Gl, so that the forming target central axis Xe1 is aligned with the central axis Xr of the main shaft 21 (only Xr is shown in FIG. 6). Then, a mandrel 40 is moved forward to be placed in the open tip end portion of the cylinder 4.

Figure 7:
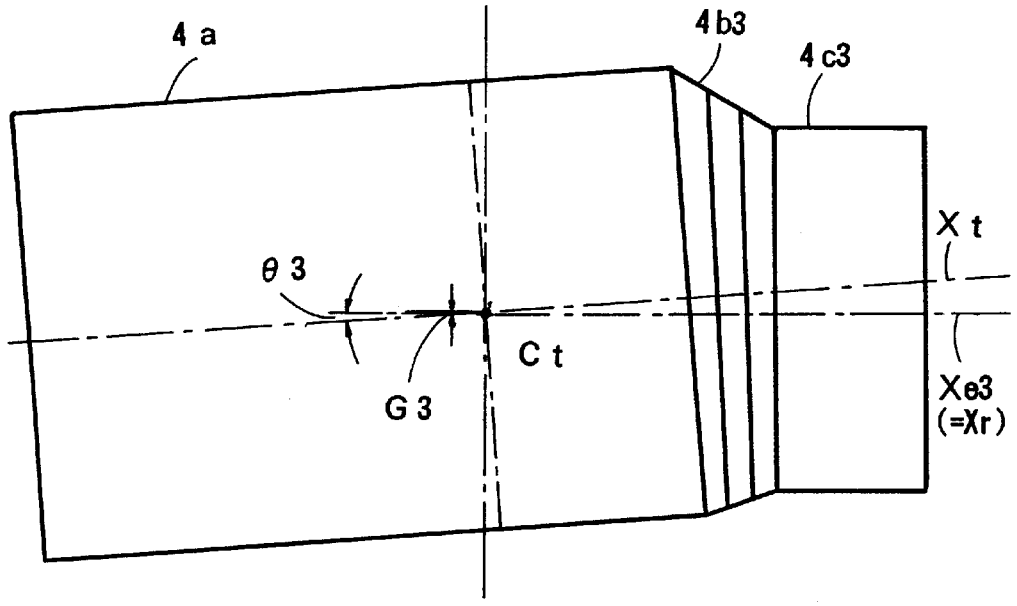
FIG. 7 is a front view of a cylinder showing an end portion thereof in each process, with a diameter thereof reduced about a forming target axis by a spinning apparatus according to an embodiment of the present invention.
Figure 8:
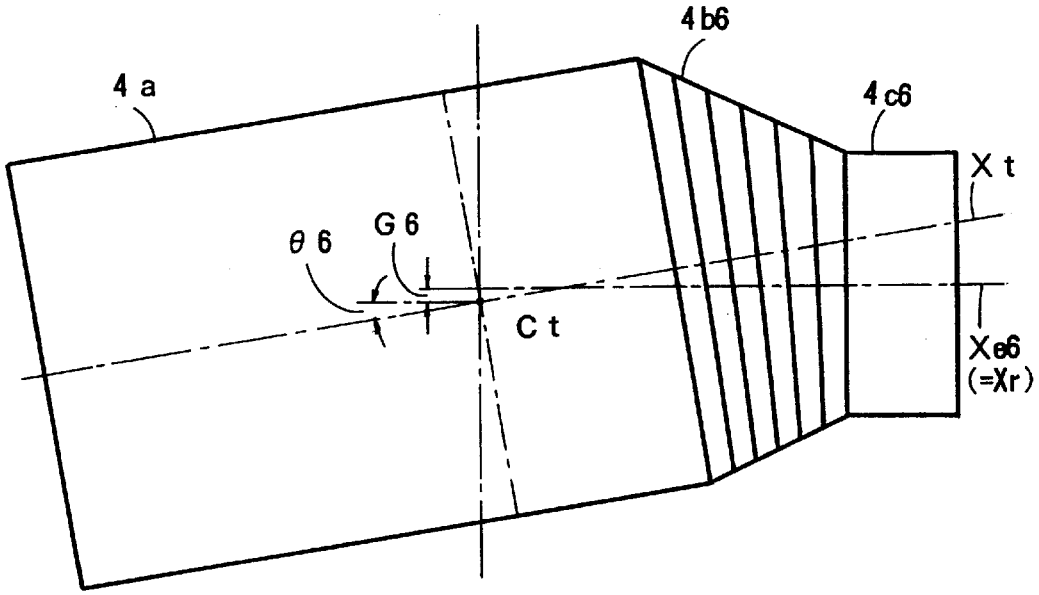
FIG. 8 is a front view of a cylinder showing an end portion thereof in each process, with a diameter thereof reduced about a forming target axis by a spinning apparatus according to an embodiment of the present invention.
Figure 9:
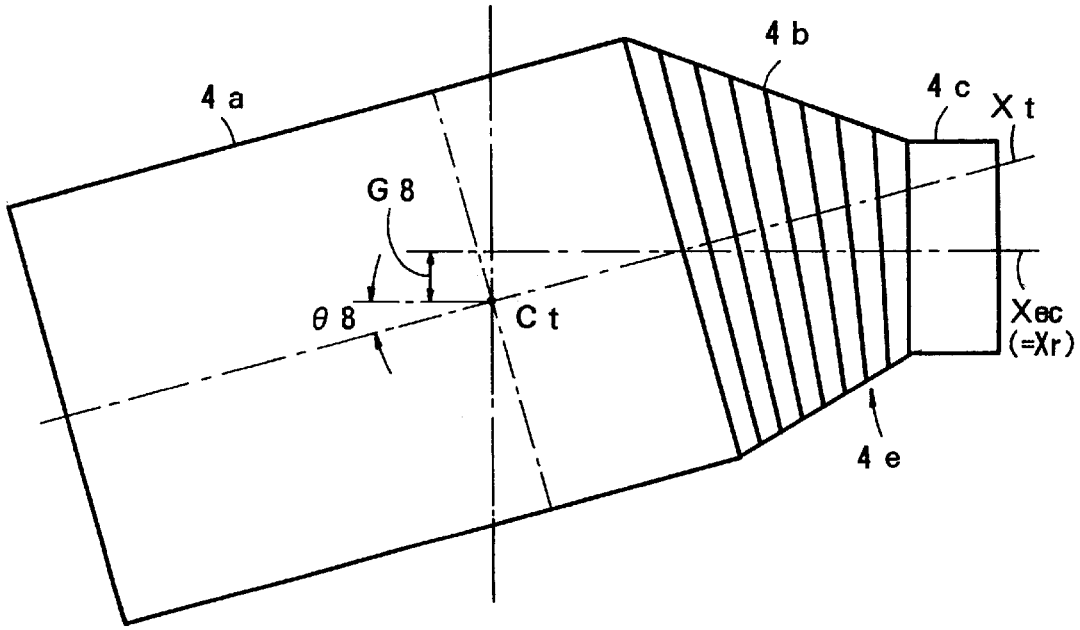
FIG. 9 is a front view of a cylinder showing an end portion thereof in each process, with a diameter thereof reduced about a forming target axis by a spinning apparatus according to an embodiment of the present invention.
Figure 10:
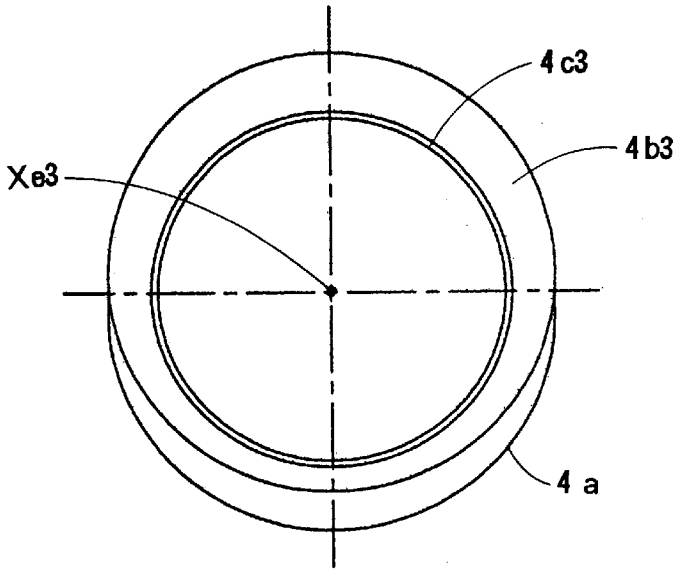
FIG. 10 is a side view of a cylinder showing an end portion thereof formed according to the process performed in FIG. 7.
Figure 11:
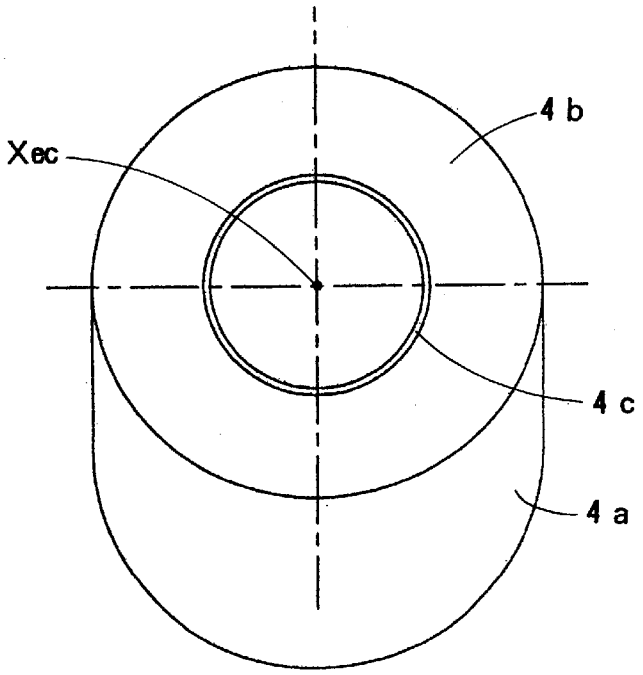
FIG. 11 is a side view of a cylinder showing an end portion thereof formed according to the process performed in FIG. 9.

From the state as described above, the main shaft 21 is rotated about the central axis Xr (=forming target central axis Xe1), and each roller 28 is rotated about the central axis Xe1 (=Xr), and the cam plate 25 is rotated through the speed changing mechanism 50, so that each roller 28 is moved toward the central axis Xe1 (=Xr). At the same time, each roller 28 is moved rearward (rightward in FIGS. 2 and 3) along the X-axis guide rail 5. Accordingly, each roller 28 is rotated by itself and rotated about the central axis Xe1 (=Xr) in such a state pressed onto the outer surface of the end portion of the cylinder 4, and moved radially toward the central axis Xe1 (=Xr) to perform the spinning process. As a result, the tapered portion 4*b*1 and neck portion 4*c*1 are formed as shown in FIG. 6. Likewise, the third forming cycle (n=3) is executed to form the tapered portion 4*b*3 and neck portion 4*c*3 as shown in FIGS. 7 and 10. Thereafter, at the sixth forming cycle (n=6), for example, the tapered portion 4*b*6 and neck portion 4*c*6 are formed as shown in FIG. 8. Lastly, when the eighth forming cycle (n=8) is executed, the tapered portion 4*b* and neck portion 4*c* having the final configurations as shown in FIGS. 9 and 11 are formed to provide the reduced diameter portion 4*d*. Figures of the intermediate products formed at the second, fourth, and fifth forming cycles are omitted herein.

Figure 12:
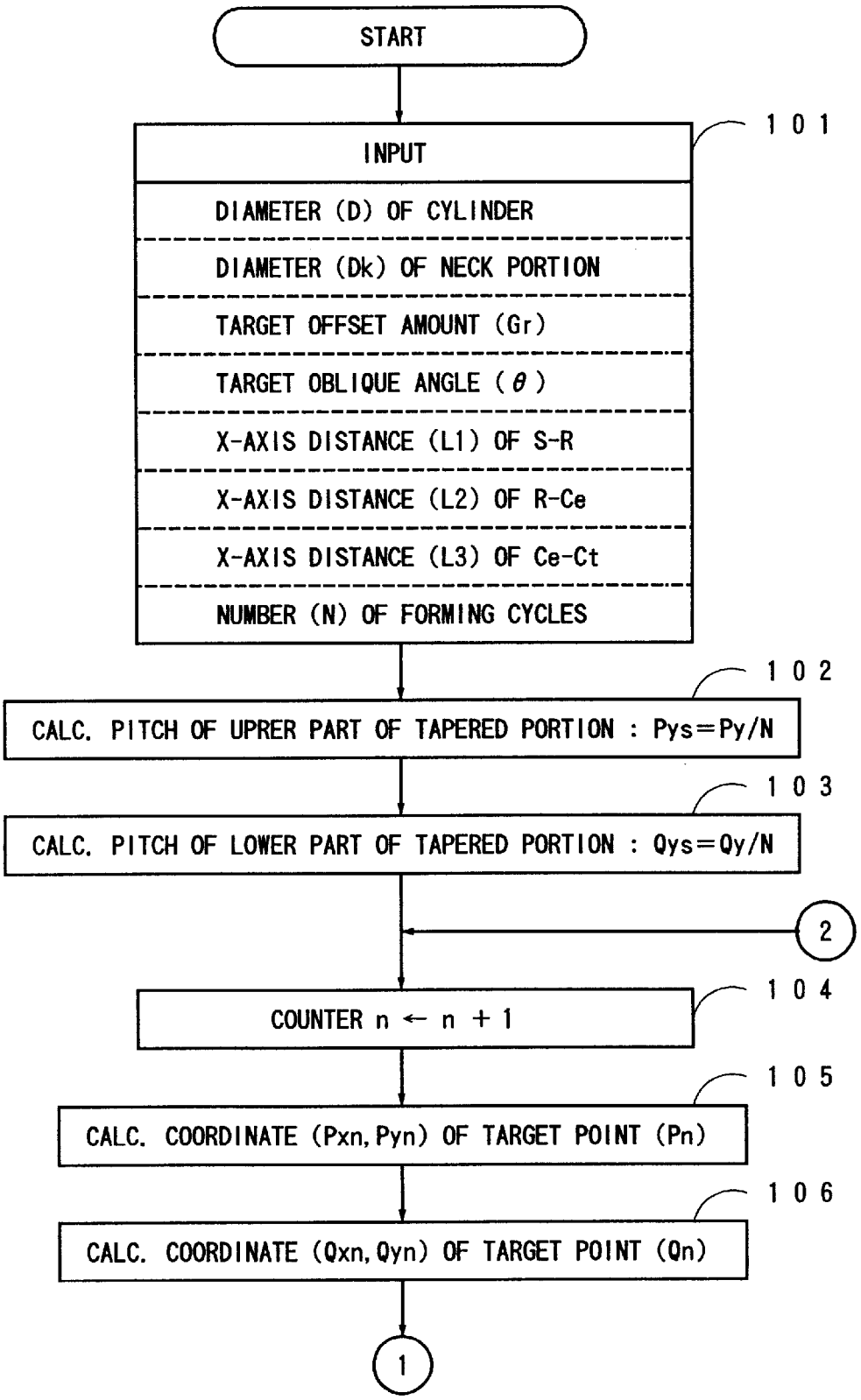
FIG. 12 is a flowchart showing operation of a spinning apparatus according to an embodiment of the present invention.
Figure 13:
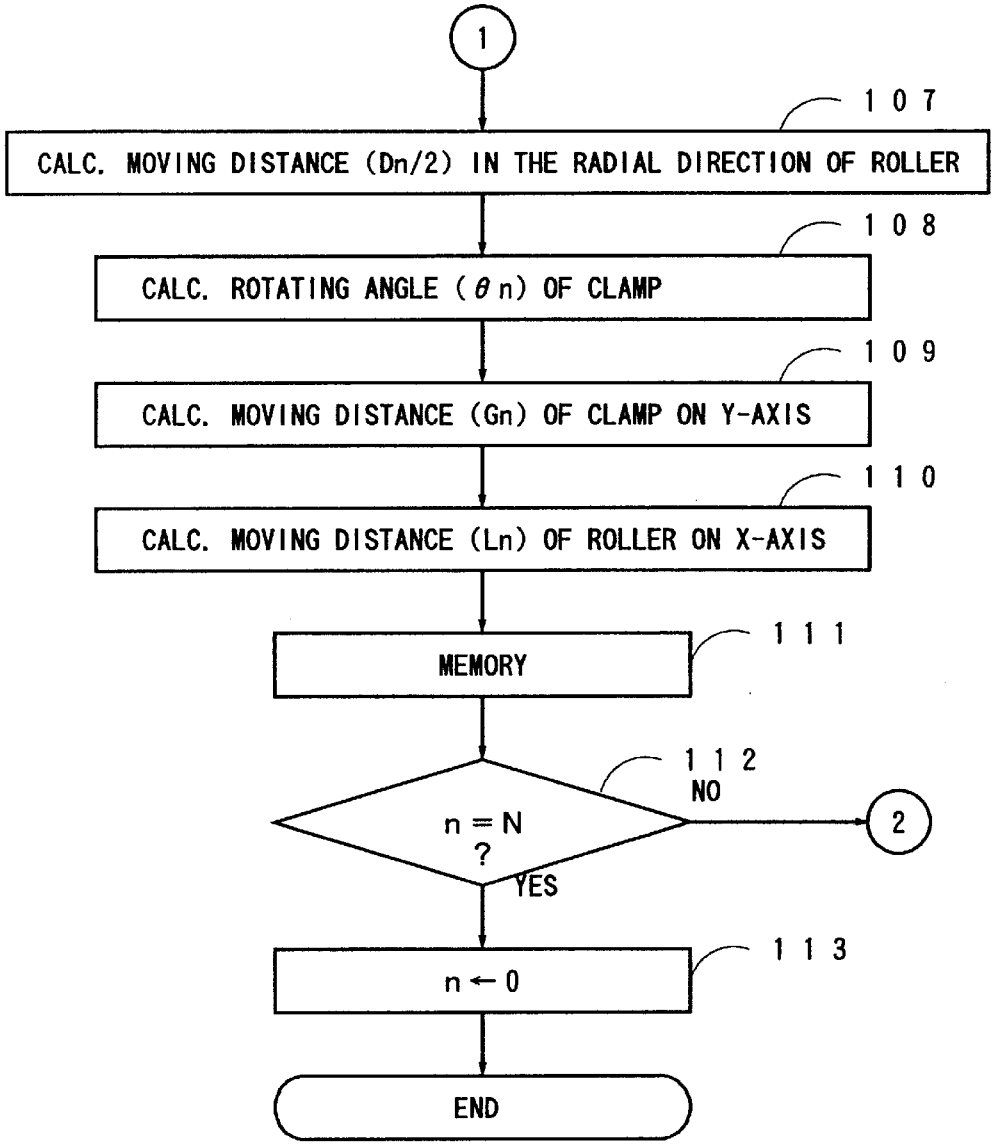
FIG. 13 is a flowchart showing operation of a spinning apparatus according to an embodiment of the present invention.
Figure 14:
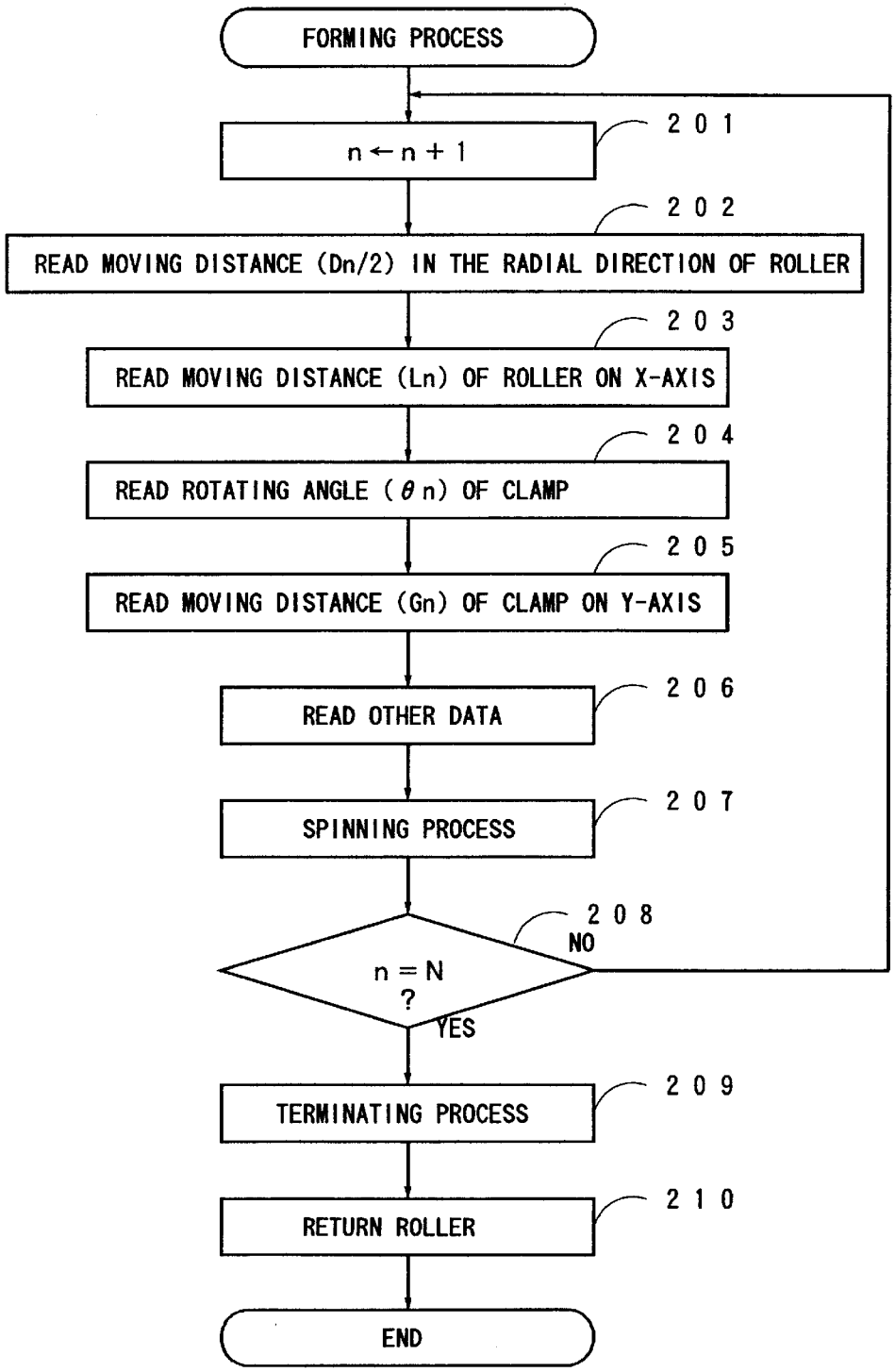
FIG. 14 is a flowchart showing a forming process according to an embodiment of the present invention.

Next will be explained the operation of the spinning process as explained above with reference to FIGS. 5–11, which will be performed by the controller CT in accordance with flowcharts as shown in FIGS. 12–14. At the outset, various parameters are input by the input device IP at Step 101. Those input into the controller CT are the diameter D of the cylinder 4, the smallest diameter of the tapered portion 4*b* to be formed, i.e., the diameter Dk of the neck portion 4*c*, the final offset Gr from the center R of the smallest diameter section of the tapered portion 4*b*, the final oblique angle θ, the distance L1 along the X-axis between the centers S-R, the distance L2 along the X-axis between the centers R-Ce, the distance L3 along the X-axis between the centers Ce-Ct, and the number (N) of forming cycles. Then, the program proceeds to Steps 102 and 103, where the pitches Pys and Qys in the Y-axis are calculated on the basis of the distances Py and Qy to be reduced, respectively. Next, the program proceeds to Step 104 where a counter for forming the cylinder is incremented (n=n+1), and the program proceeds to Steps 105 and 106 where the coordinate (Pxn, Pyn) of the forming target point Pn of the upper part of the tapered portion, and the coordinate (Qxn, Qyn) of the forming target point Qn of the lower part of the tapered portion are calculated.

Then, the program proceeds to Steps 107, 108, 109 and 110 in FIG. 13, where the distance of the roller 28 moved in a radial direction (i.e., a half of the distance Dn in FIG. 5), the rotating angle of the clamp device 12 (i.e., the angle θn in FIG. 5), the distance of the roller 28 moved along the Y-axis (i.e., the distance Gn in FIG. 5), and the moving distance of the roller 28 moved along the X-axis (i.e., the distance Ln in FIG. 5), respectively. Those results are memorized in the memory ME at Step 111. The operation performed at Steps 105–111 are repeated until the value (n) of the counter becomes "N" (eight in this embodiment) at Step 112, and when the calculation is terminated, the value (n) of the counter is cleared to be zero (n=0) at Step 113, and the above forming sequence is memorized.

Next will be explained the forming process according to the above forming sequence with reference to the flowchart as shown in FIG. 14. After the counter is incremented (n=n+1) at Step 201, the moving distance (Dn/2) of the roller 28 in the radial direction, the moving distance (Ln) of the roller 28 along the X-axis, the rotating angle (θn) of the clamp device 12, the moving distance (Gn) of the roller 28 along the Y-axis, and other data relating to the spinning process are read from the memory ME, at Steps 202–206, respectively. Based on those data, the cylinder 4 and roller 28 are moved relative to each other, and the roller 28 is rotated about the main shaft 21 (central axis Xr) thereby to perform the first spinning process at Step 207. Instead, that process may be made by a 4-axes simultaneous motion, where the devices for performing the operations to be performed at Steps 202–205 are actuated simultaneously, thereby to shorten the forming time. At the same time, the forming operation is made consecutively, so that the formed amount will be constant to improve the accuracy of the finished configuration, and further improve the flexibility of the configuration to be formed. Likewise, based on the moving distance and the like read at Steps 201–206, the second and following spinning processes are performed at Step 207, and repeated until the value (n) of the counter becomes "N" (=8) at Step 208. As a result, the reduced diameter portion is formed at the end portion of the cylinder 4, as shown in FIGS. 6–9. When the spinning process is terminated, the program proceeds to Step 209 where a terminating process is made to clear various memorized data and so on, and proceeds to Step 210 where the roller 28 or the like will be returned to its initial position. According to the embodiment as shown in FIG. 5, the cylinder 4 is formed by a combination of the spinning process about the oblique axis and the spinning process about the offset axis. In the case where the final oblique angle θ is zero, therefore, the spinning process will correspond to the offset spinning process, and in the case where the final oblique angle θ is zero, and at the same time the final offset amount Gr is zero, the spinning process will correspond to the coaxial spinning process.

According to the reducing diameter process in the present embodiment as described above, the spinning process is performed around each of a plurality of forming target central axes (Xe1–Xe8, Xec), consecutively, in the state that the roller 28 is always in contact with the surface (tapered portion 4*b* and neck portion 4*c*) of the cylinder 4 to be formed, so that not only a smoothly formed surface can be obtained, but also reduction in thickness of the formed portion, or biased thickness thereof can be minimized to ensure a desired strength. In addition, since the forming process is not performed in so severe conditions, the overall forming limit will be improved. Also, no excessive load will be applied to the roller 28 or the like, the forming process can be performed smoothly. Furthermore, the diameter of the mandrel 40 is set to be equal to the inner diameter of the neck portion 4*c* to be formed on the cylinder 4, and the spinning process is performed, with the neck portion 4*c* clamped between the mandrel 40 and the roller 28, so that a smooth surface can be formed on the neck portion 4*c*.

In the case where it is required to form the opposite ends of the cylinder 4 by the spinning process, it is necessary to reverse one end portion of the cylinder 4 after the one end portion was formed by the spinning process. If the reversing operation is made by hand after the apparatus is once stopped, not only the operation will be troublesome, but also its forming time will be prolonged. In order to form the cylinder 4 into the one with both end portions thereof having a three-dimension like relationship between them, it will become necessary to reverse the cylinder 4 and rotate it in its circumference direction, so that adjustment for positioning the cylinder 4 will not be made easily. According to the embodiment as shown in FIGS. 15–21, therefore, the clamp device 12 is slightly modified, and there is provided a chuck device 60 as described hereinafter.

Figure 15:
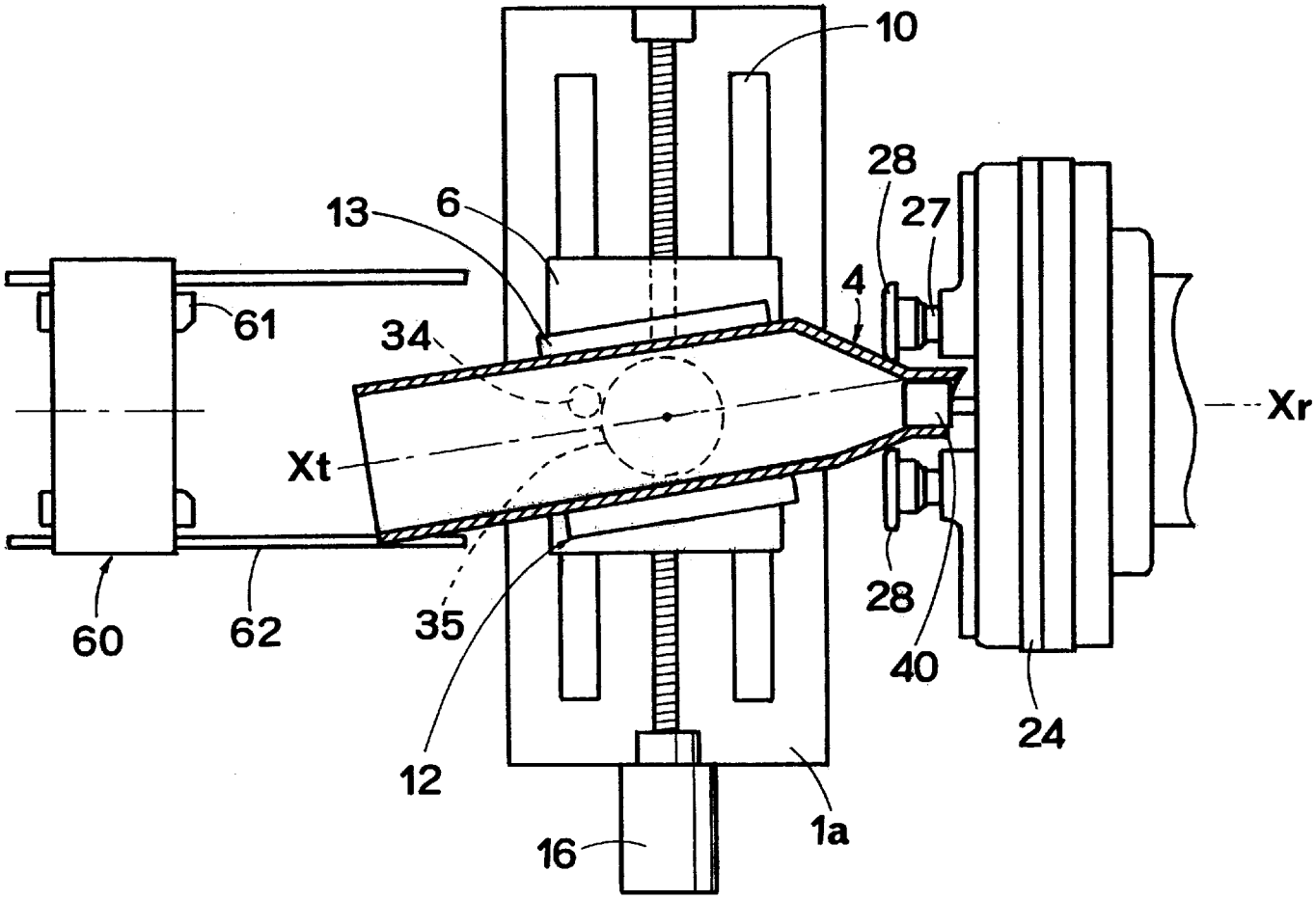
FIG. 15 is a plan view of a spinning apparatus with a portion thereof sectioned according to another embodiment of the present invention.
Figure 21:
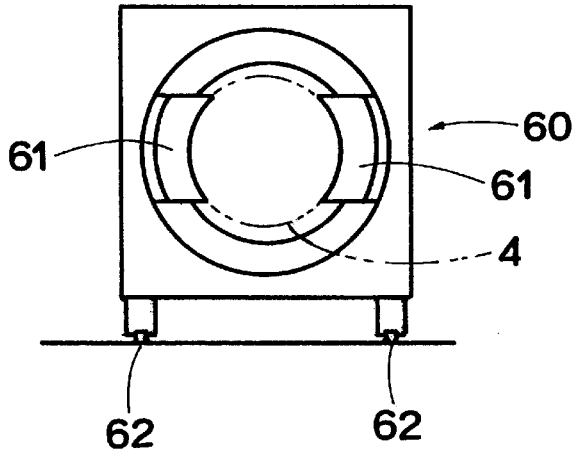
FIG. 21 is a front view of a chuck device according to another embodiment of the present invention.

Referring to FIG. 15, a driving mechanism for driving the clamp device 12 is provided with a gear 34 which is arranged to be driven by the shaft 31*a* of the motor 31 (FIG. 2), and a gear 35 which is engaged with the gear 34 and which is arranged to drive the lower clamp 13 to be rotated 360 degree on a plane in parallel with the bed 1*a*. The chuck device 60 is arranged opposite to the roller 28, so that the clamp device 12 is placed between them. As shown in FIGS. 15 and 21, the chuck device 60 is provided with a pair of chucks 61, which are movable in a radial direction toward the axis aligned with the central axis Xr of the main shaft 21, and which are capable of holding the cylinder 4 as shown in FIG. 21, to rotate the cylinder 4 about the central axis Xr (FIG. 15) for indexing it. The chuck device 60 is arranged to be movable toward and away from the clamp device 12 by means of an electric motor (not shown) which is actuated by the controller CT during the spinning process.

Figure 16:
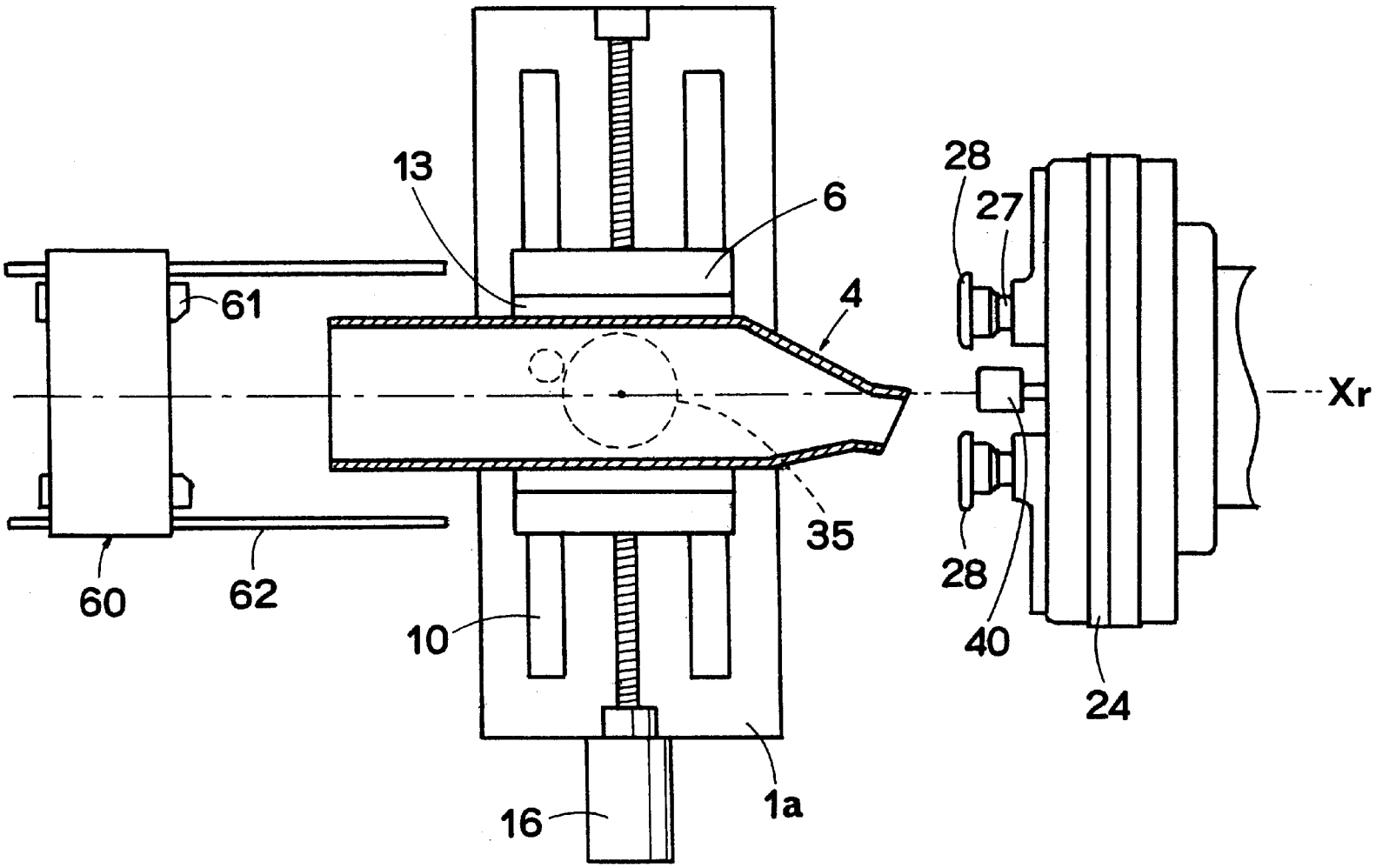
FIG. 16 is a plan view of a spinning apparatus with a portion thereof sectioned according to another embodiment of the present invention.
Figure 17:
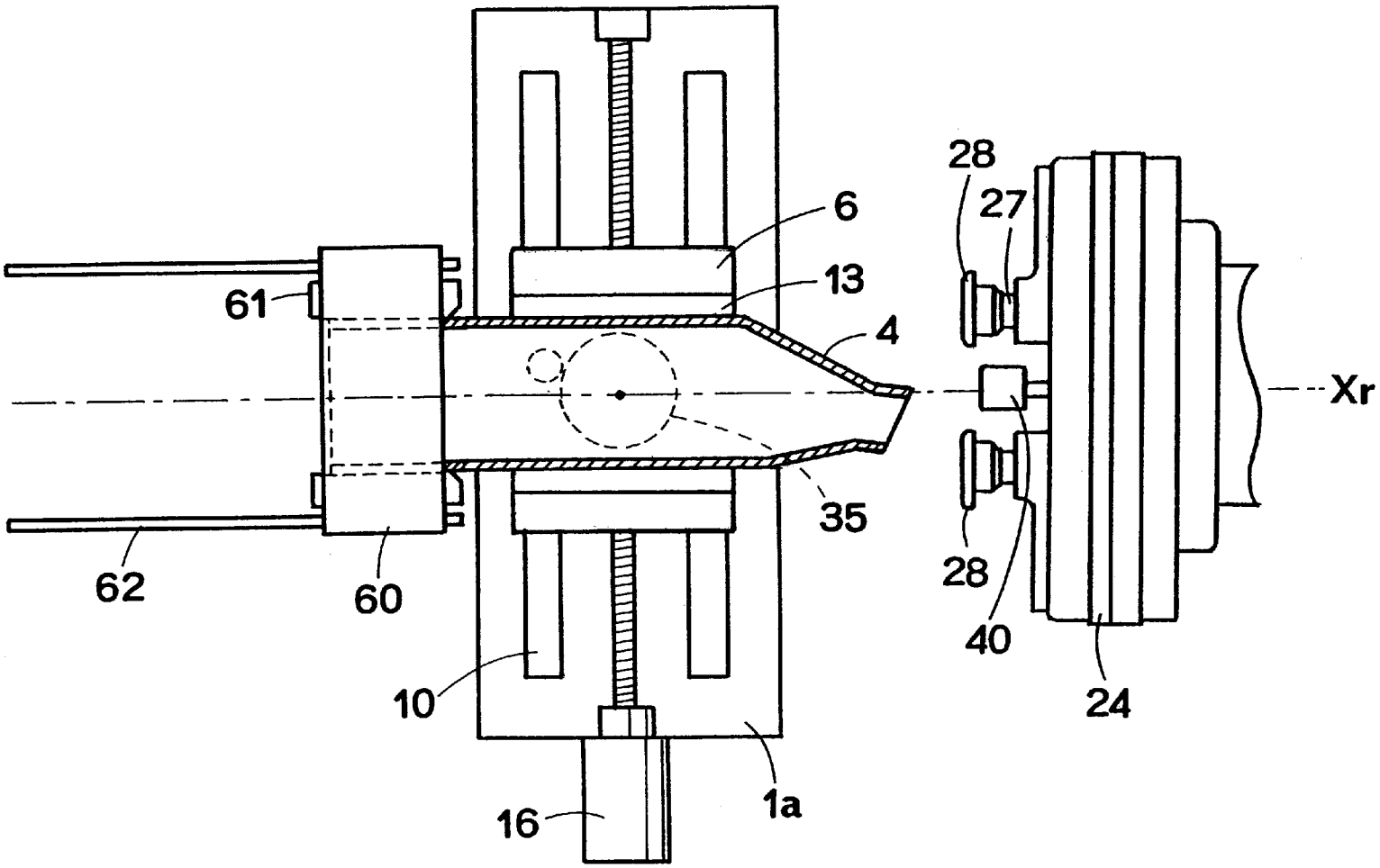
FIG. 17 is a plan view of a spinning apparatus with a portion thereof sectioned according to another embodiment of the present invention.
Figure 18:
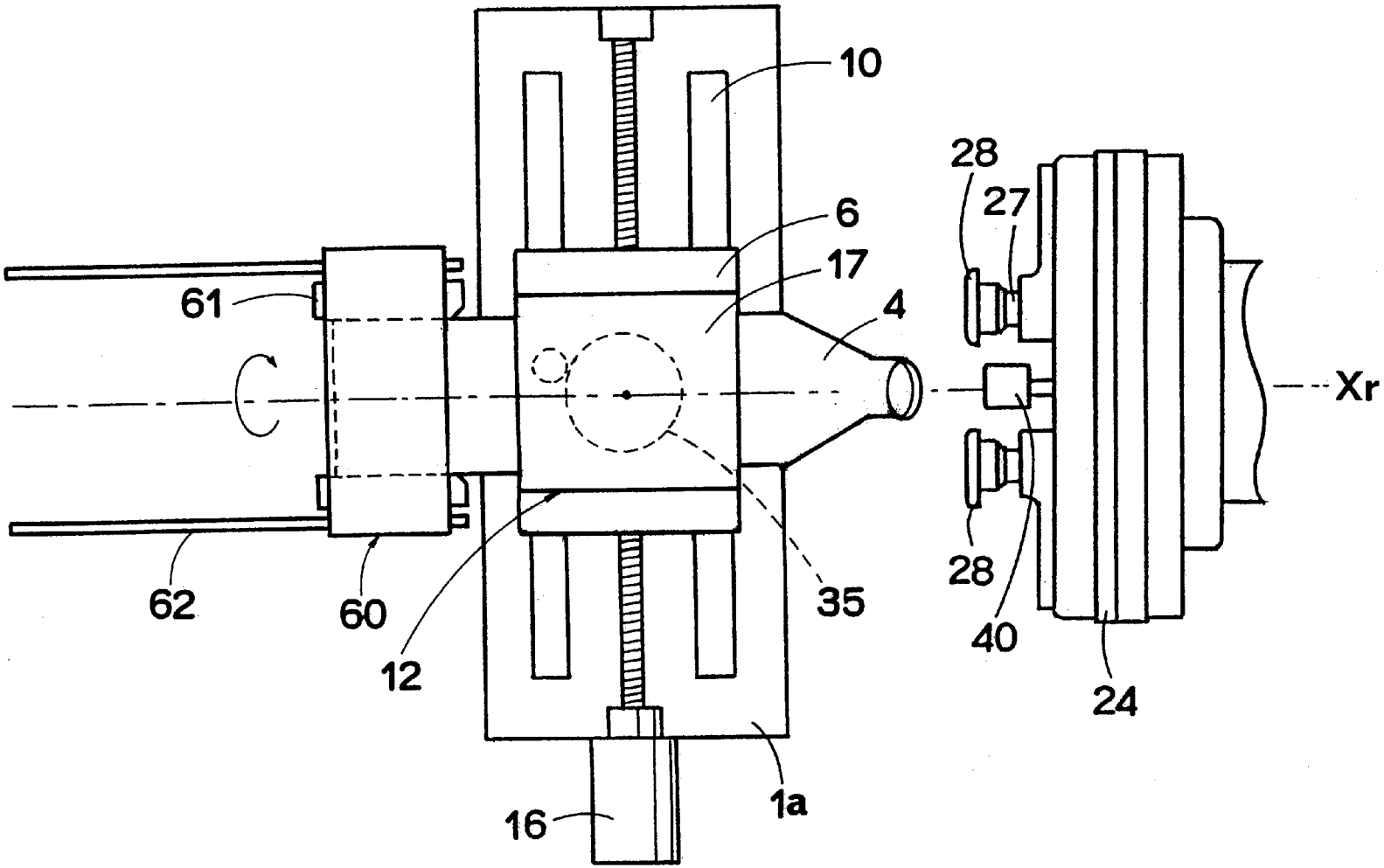
FIG. 18 is a plan view of a spinning apparatus with a portion thereof sectioned according to another embodiment of the present invention.

FIG. 15 shows such a state that after the spinning process was finished with respect to one end portion of the cylinder 4 as in the above-described embodiment, the chucks 61 were moved outward to release the cylinder 4 from being held by the chucks 61 (cf. FIG. 21), and then the chuck device 60 was retracted along the rails 62. In this state, the clamp device 12 is rotated about the center of the gear 35, and the cylinder 4 is returned to its initial position on the axis aligned with the axis Xr of the cylinder 4 as shown in FIG. 16. Then, the rollers 28 are retracted to their initial positions placed at the right side in FIG. 16. Thereafter, the upper clamp 17 (FIG. 2) of the clamp device 12 is lifted upward so that the cylinder 4 is in its unclamped state. Then, as shown in FIG. 17, the chuck device 60 is moved forward along the rails 62, and the other end portion of the cylinder 4 is held by the chucks 61. And, the chuck device 60 is rotated about the central axis Xr together with the cylinder 4, to perform the indexing. That is, they are rotated as indicated by an arrow in FIG. 18. When the cylinder 4 is rotated a predetermined rotational angle, the upper clamp 17 is lowered, so that the cylinder 4 is clamped between the upper clamp 17 and the lower clamp 13. Then, the chuck device 60 is retracted leftward in FIG. 18. In the case where the both ends of the cylinder 4 are to be formed on the same plane, the indexing will not be performed, but only the reversing operation will be performed.

Figure 19:
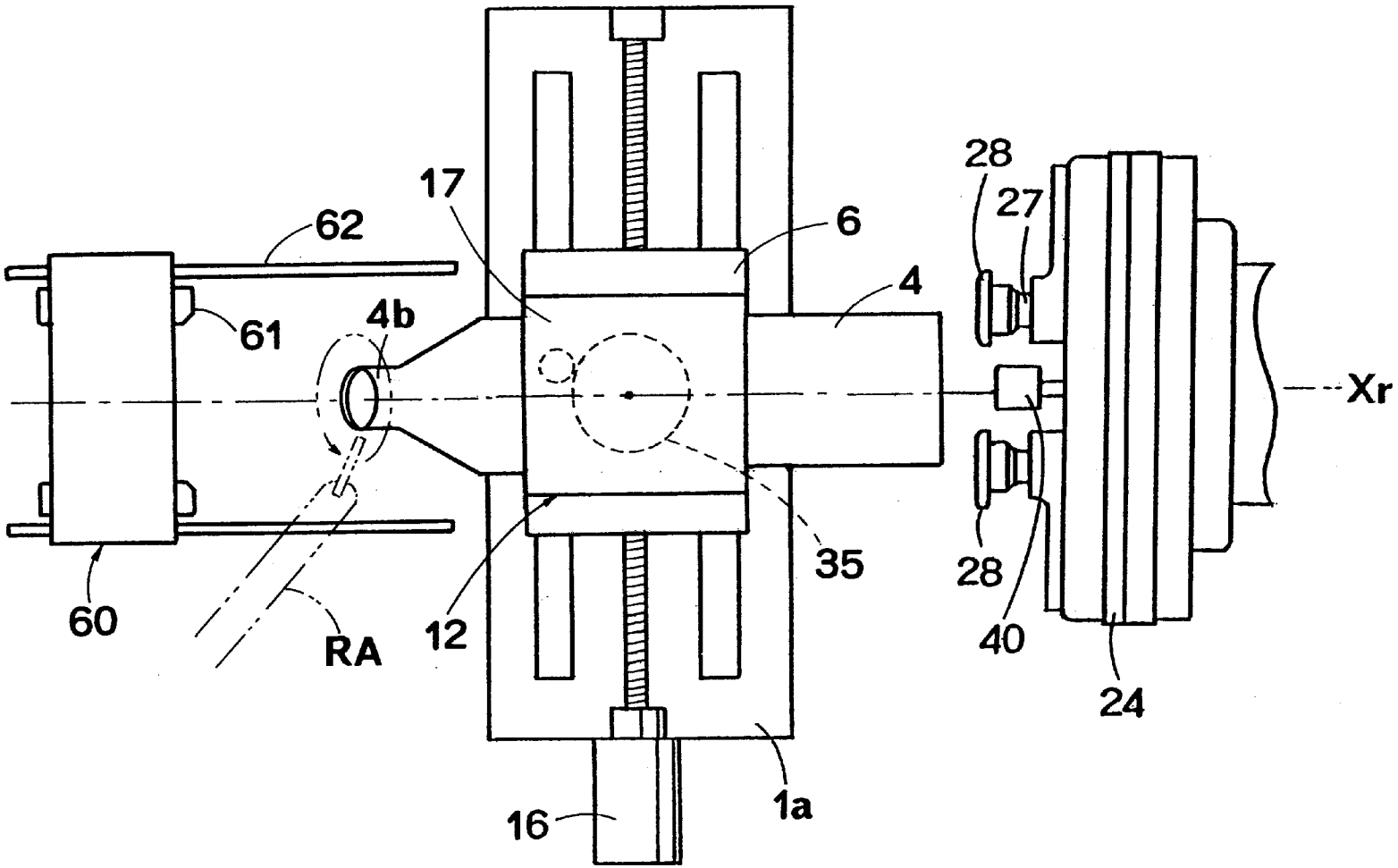
FIG. 19 is a plan view of a spinning apparatus with a portion thereof sectioned according to another embodiment of the present invention.
Figure 20:
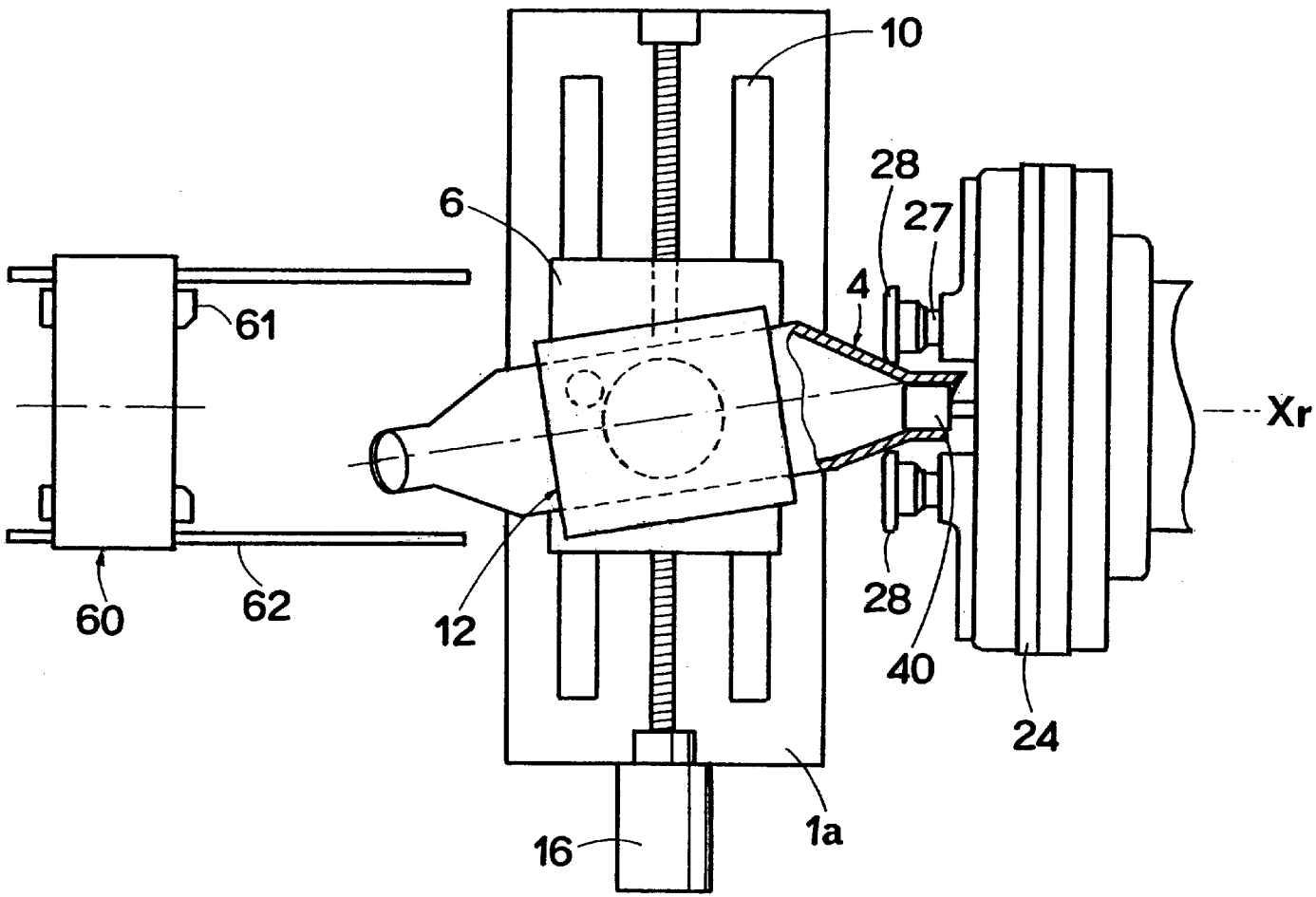
FIG. 20 is a plan view of a spinning apparatus with a portion thereof sectioned according to another embodiment of the present invention.

In the state as described above, when the clamp device 12 with the cylinder 4 clamped thereby is rotated about the center of the gear 35 by 180 degree, the cylinder 4 is reversed as shown in FIG. 19. In this case, trimming of the neck portion 4*b* may be made, if necessary, by a laser cutting device (not shown) through a robot arm RA as indicated by a two-dot chain line in FIG. 19. Then, the spinning process is performed with respect to the other end portion (right side in FIG. 19) of the cylinder 4, thereby to form the cylinder 4 as shown in FIG. 20. Thereafter, the cylinder 4 is released from being held by the clamp device 12, so that the finished cylinder 4 is removed from the apparatus. According to the present embodiment, therefore, the spinning process can be performed for both end portions of the cylinder 4 consecutively in a single working process, so that the working time can be shortened comparing with the former embodiment. Furthermore, if the chuck device 60 is so constituted that it can be rotated or moved together with the cylinder 4, the indexing can be made without its returning operation to the initial position (FIG. 16) being performed, so that the working time can be shortened further.

Figure 22:
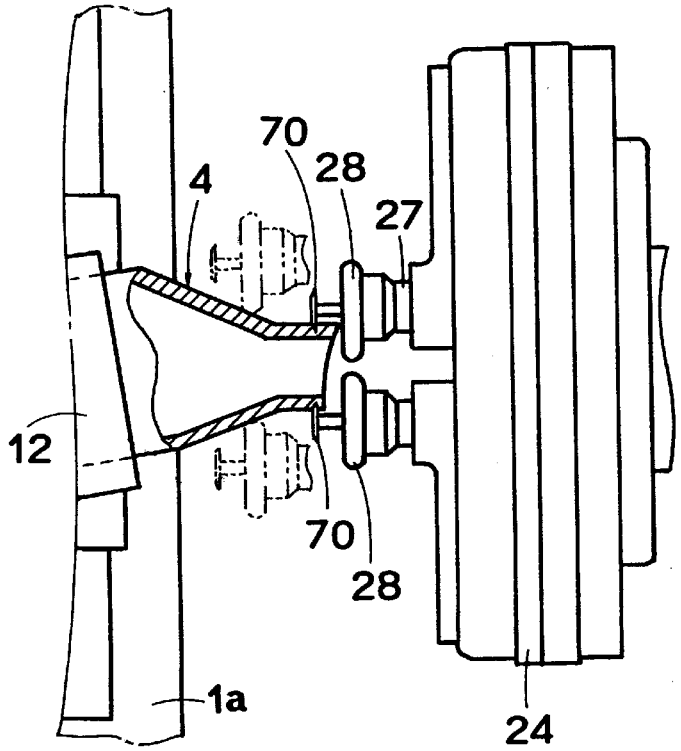
FIG. 22 is a plan view of a spinning apparatus with a portion thereof sectioned according to a further embodiment of the present invention.

According to the embodiment as shown in FIG. 19, the trimming of the neck portion 4*b* is made by the laser cutting device (not shown), after the spinning process was finished, separately. On the contrary, if a circular plate-like cutting element 70 having a smaller diameter than that of each roller 28 is mounted on the tip end of each roller 28, the trimming can be made, immediately after the spinning process was made. In this case, the cutting element 70 may be fixed to the tip end of each roller 28 to be rotated with a the roller 28 in a body, or may be rotatably mounted on the roller 28 to be rotated independently thereof. Or, the cutting element 70 may be disposed between the neighboring rollers 28, and rotatably mounted on the flange 24, separately from the rollers 28, although a mechanism for driving the cutting element 70 will be complicated. According to the embodiment as shown in FIG. 22, therefore, immediately after the spinning process was performed as shown by two-dot chain lines in FIG. 22, the trimming of the neck portion 4*b* is made by the cutting element 70, so that an end face of the neck portion 4*b* is formed to be perpendicular to the central axis.

In the embodiment as described above, the case 20 is moved along the X-axis, and the cylinder 4 is moved along the Y-axis, so that they are moved relative to each other. Whereas, it may be so constituted that the case 20 is fixed to the base BS, while the cylinder 4 is moved along the X-axis and Y-axis. That is, the first driving mechanism 1 may be gathered at the left side in FIG. 2. Furthermore, in the embodiment as described above, the central axis Xt of the cylinder 4 is fixed to a position of a predetermined height above the base BS, so as to be located on the same plane as the central axis Xr of the main shaft 21 in parallel with the base BS. The height of the central axis Xt of the cylinder 4 to the base BS may be adapted to be variable, and the central axis Xt may be adjusted perpendicularly relative to the central axis Xr of the main shaft 21. In other words, the apparatus may be provided with a servo motor that drives the cylinder 4 vertically, so that a fine adjustment will be made more easily, as will be described hereinafter with reference to FIGS. 23 and 24.

Figure 23:
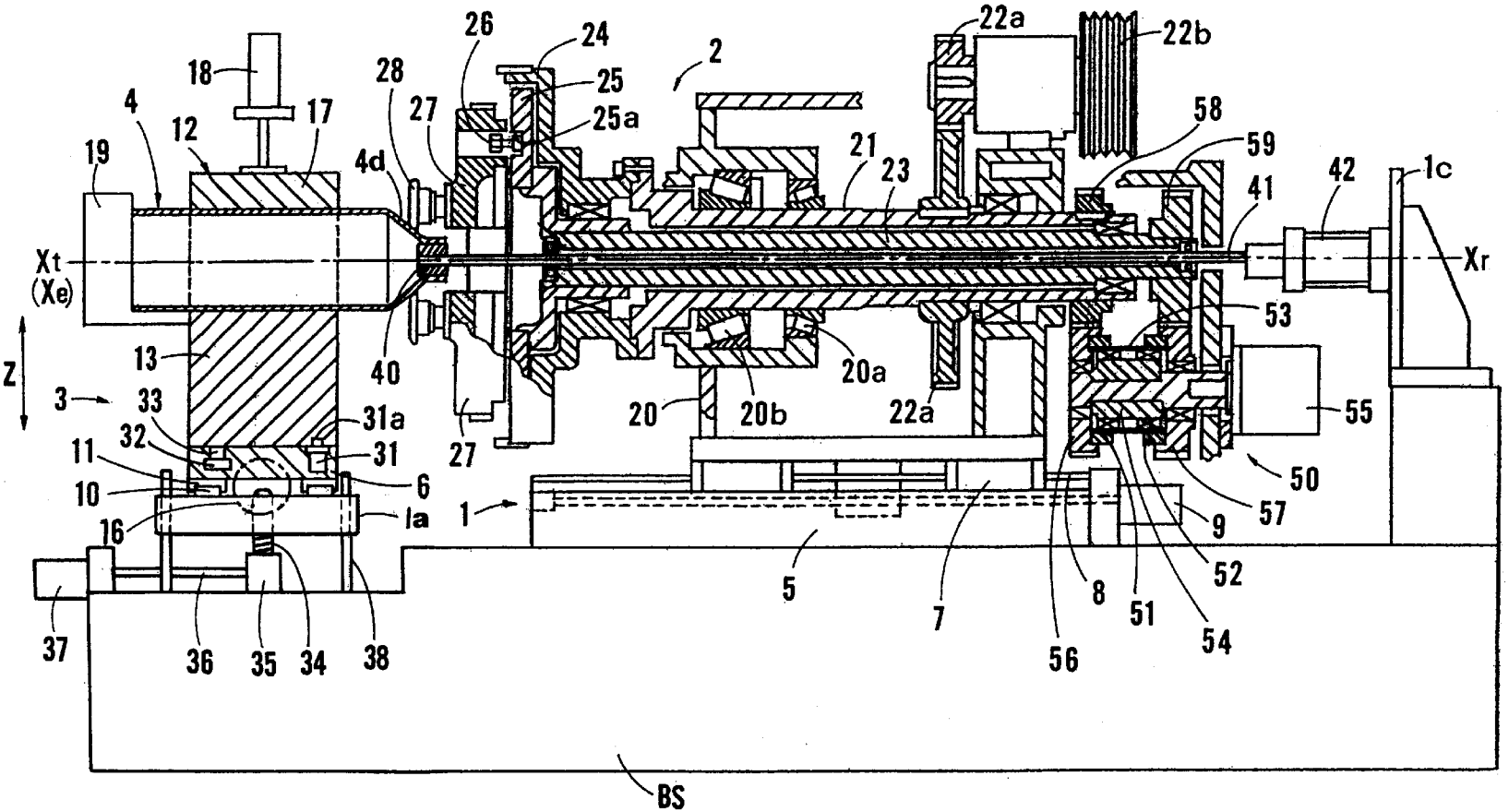
FIG. 23 is a side view of a spinning apparatus with a portion thereof sectioned according to an embodiment of the present invention.
Figure 24:
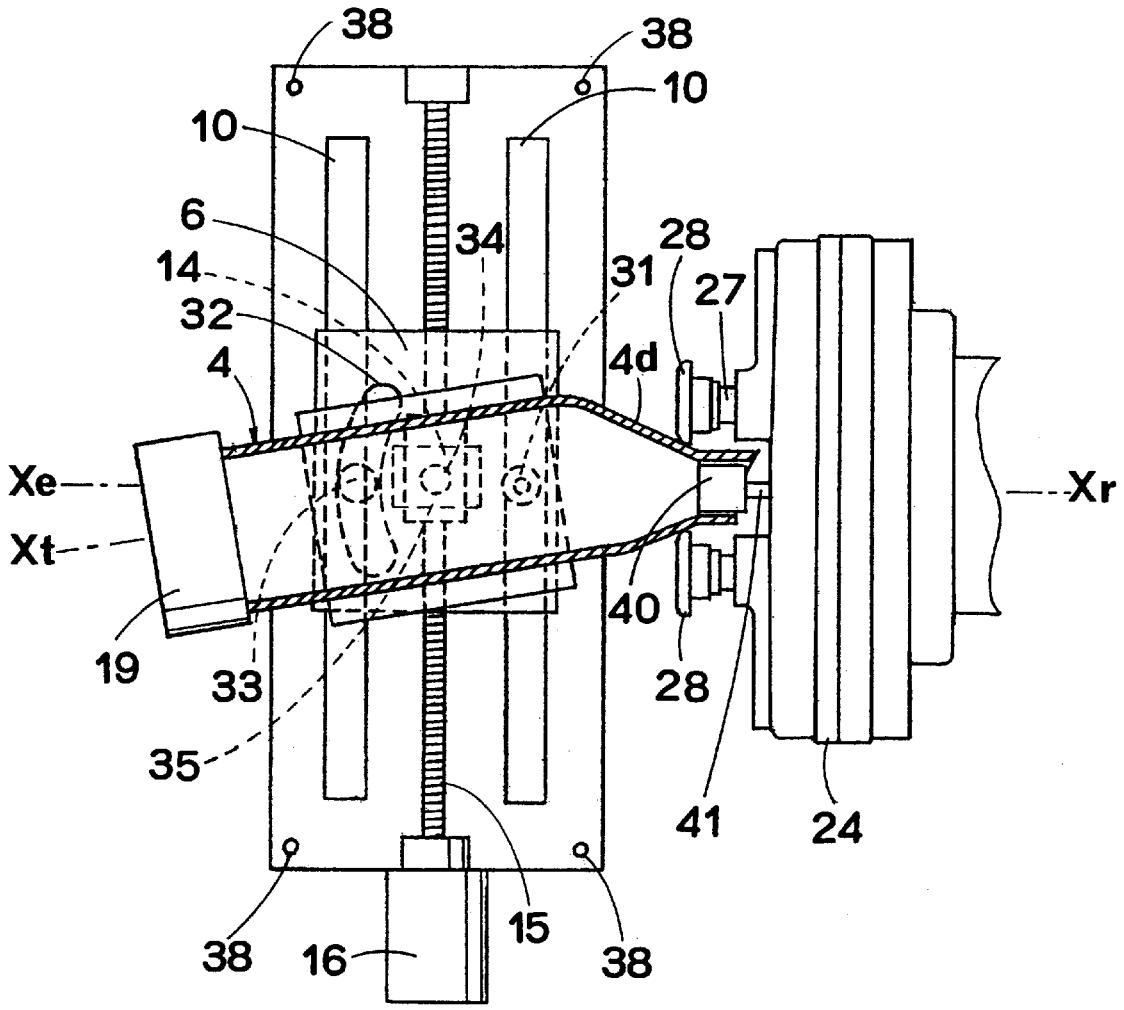
FIG. 24 is a plan view of a spinning apparatus with a portion thereof sectioned according to an embodiment of the present invention.

In FIGS. 23 and 24, the bed 1*a* is slidably mounted on Z-axis guide posts 38 for movement in the Z direction so that the axis Xt of the cylinder 4 can be adjusted relative to the axis Xr of the main shaft 21. The first driving mechanism 2 may also include a gear box 35 between the bed 1*a* and the base BS. The gear box 35 is engaged with a spline shaft 34 that is engaged with a hole defined in the bed 1*a*. The gear box 35 is also connected to a servo motor 37 secured to the base BS through a connecting shaft 36. When the connecting shaft 36 is rotated by the servo motor 37, the spline shaft 34 is rotated through the gear box 35 so that the bed 1*a* is moved in the Z direction. Therefore, the axis Xt of the cylinder 4 can be adjusted to be located at a predetermined position relative to the base BS and the axis Xt can be adjusted relative to the axis Xr of the main shaft 21. Consequently, the axis Xt of the cylinder 4 can be offset along not only the Y-axis but also the Z-axis so that a fine adjustment can be easily made in the spinning process. Although not shown in FIGS. 23 and 24, the servo motor 37 can also be controlled by a controller CT as shown in FIG. 1 through a driving circuit.

Figure 25:
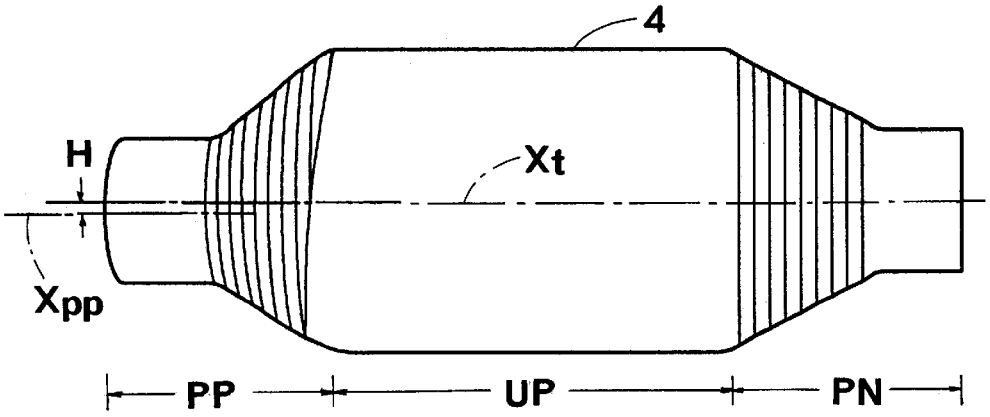
FIG. 25 is a plan view of a cylinder having a changed diameter portion with a central axis skewed relative to a central axis of an unprocessed portion.
Figure 26:
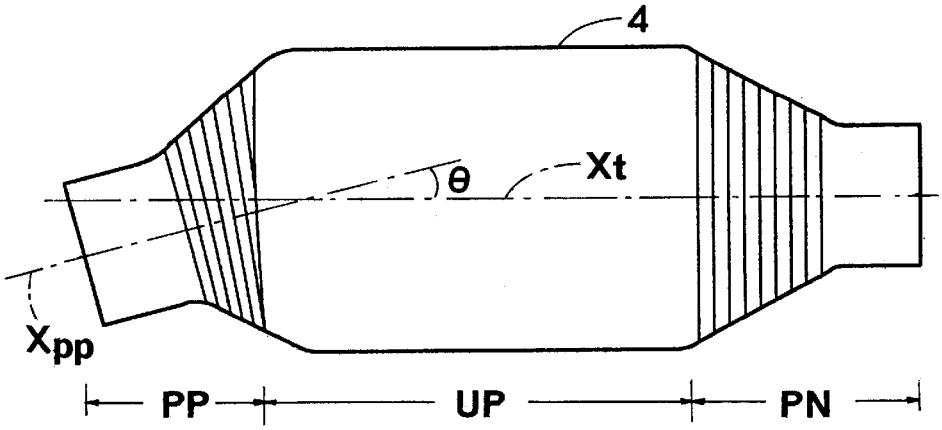
FIG. 26 is a front view of a cylinder having a changed diameter portion with a central axis skewed relative to a central axis of an unprocessed portion.
Figure 27:
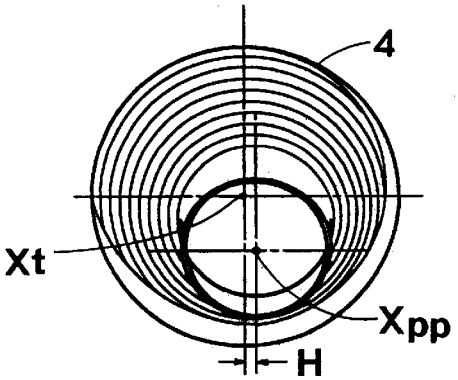
FIG. 27 is a side view of a cylinder having a changed diameter portion with a central axis skewed relative to a central axis of an unprocessed portion.

According to the apparatus as shown in FIGS. 23 and 24, therefore, the cylinder 4 may be supported so that the axis Xt of the cylinder 4 is offset along the Z-axis from the axis Xr of the main shaft 21 by an offset distance H and is at an oblique angle θ to the axis Xr of the main shaft 21. Thus, the axes Xt, Xr are skewed relative to another as they are not in the same plane nor do they intersect one another. FIGS. 25–27 illustrate an example of a cylindrical member 4 having a processed portion PP with a central axis Xpp skewed from the central axis Xt of the unprocessed portion UP, as shown in the left side of FIGS. 25 and 26, while a processed portion PN at the right side has a central axis that is coaxial with the central axis Xt of the unprocessed portion UP. The central axis Xpp of the processed portion is offset from the central axis Xt of the unprocessed portion UP by a distance H and is also oblique to the central axis Xt at an angle θ.

Figure 28:
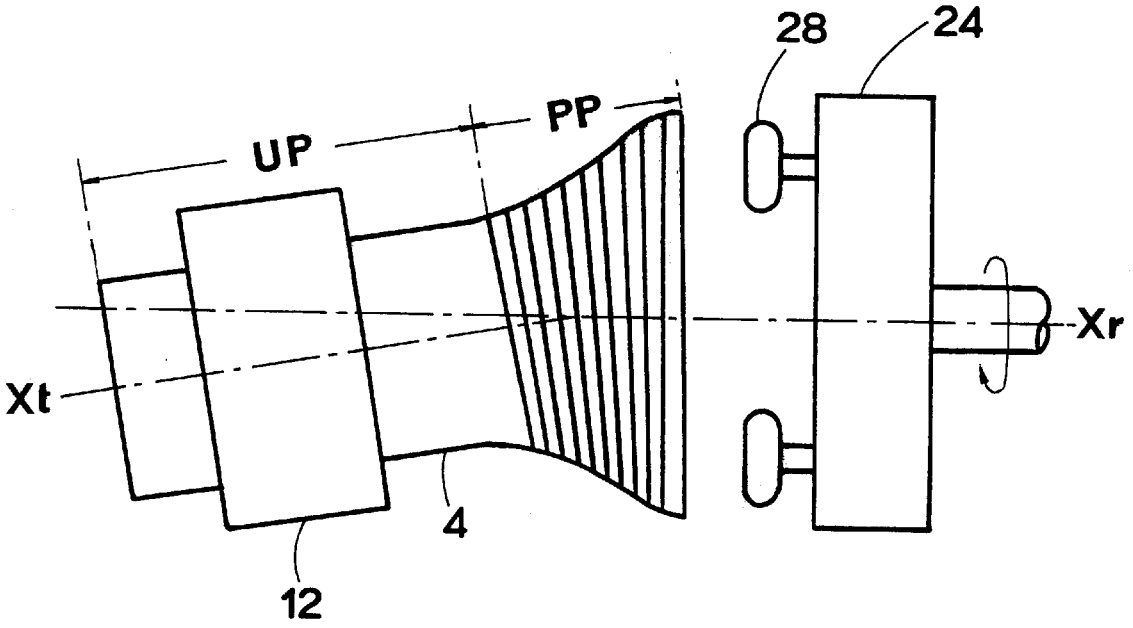
FIG. 28 illustrates a spinning process according to an exemplary embodiment of the present invention.

Although the previous embodiments have been described in relation to diameter reduction processes, it should be appreciated that the diameter of the processed portion PP may be enlarged by the rollers 28 engaging an inner surface of the cylinder 4 during the spinning process as shown in FIG. 28.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for forming a processed portion of a workpiece to be processed so as to form a processed portion having a diameter different from an unprocessed portion of the workpiece and a central axis different from the unprocessed portion, comprising:

supporting the workpiece so that the central axis of the portion to be processed is aligned with one of a plurality of forming target axes, the plurality of forming target axes corresponding to a plurality of target processed portions of the workpiece changed from the unprocessed portions of the workpiece changed from the unprocessed portion to a final target processed portion of the workpiece with a central axis of the final target processed portion being at least one of offset from, oblique to and skewed from a central axis of the unprocessed portion;

molding the portion to be processed by a spinning process so that the central axis of the portion to be processed is forced to match each forming target axis of the plurality of forming target axes, and simultaneously changing the diameter of the portion to be processed, of each target processed portion.

2. The method of claim 1, wherein the spinning process comprises rotating the workpiece and at least one roller relative to each other about each forming target axis, and moving at least the one roller radially relative to each forming target axis into contact with a surface of the portion to be processed to force the central axis of the portion to be processed to match each forming target axis and to simultaneously change the diameter of the portion to be processed, of each target processed portion.

3. The method of claim 2, wherein the spinning process further comprises a plurality of cycles, each cycle beginning in a state in which the central axis of the portion to be processed is aligned with each forming target axis of the plurality of forming target axes.

4. The method of claim 3, wherein the spinning process further comprises, at the beginning of each cycle, moving each forming target axis and the central axis of the portion to be processed relative to each other and setting each forming target axis and the central axis of the portion to be processed so that the central axis of the portion to be processed is aligned with each forming target axis of the plurality of forming target axes.

5. The method of claim 4, wherein the spinning process further comprises moving the workpiece during contact of the at least one roller with the surface of the portion to be processed.

6. The method of claim 1, further comprising; rotating the workpiece about a perpendicular axis thereto, after one end portion of the workpiece was processed to form the final target processed portion, to support the workpiece so that the other one end portion of the workpiece is processed by a spinning process.

7. The method of claim 6, further comprising; holding the workpiece, after the one end portion of the workpiece was processed to form the final target processed portion, and rotating the workpiece about a central axis of the unprocessed portion to position the other one end portion of the workpiece in a predetermined relationship with the one end portion of the workpiece.

8. The method of claim 2, further comprising; trimming the formed portion of the workpiece by at least one trimming member mounted on the at least one roller, sequentially after the spinning process was finished.

9. The method of claim 2, wherein three rollers are rotated relative to the workpiece, and moved radially relative to each forming target axis.

10. The method of claim 1, wherein the workpiece is cylindrical.

11. An apparatus for processing a portion of a workpiece by spinning to form a processed portion having a diameter different from an unprocessed portion of the workpiece and a central axis different from the unprocessed portion, comprising:

a rotatable member rotatable about a main axis;

at least one roller operatively mounted on the rotatable member to be radially movable to and from the main axis, and in contact with a surface of the portion to be processed;

first driving means for moving at least one of the workpiece and the at least one roller relative to each other so that the central axis of the portion to be processed is aligned with one of a plurality of forming target axes, the plurality of forming target axes corresponding to a plurality of target processed portions of the workpiece changed from the unprocessed portion of the workpiece to a final target changed diameter portion of the workpiece with a central axis of the final target processed portion being at least one of offset from, oblique to and skewed from a central axis of the unprocessed portion;

second driving means for moving the at least one roller radially toward each forming target axis of the plurality of forming target axes, with the at least one roller being in substantial contact with the surface of the portion to be processed and rotating the at least one roller about the main axis relative to the workpiece; and control means for controlling the first and second driving means to form the portion to be processed into the final target changed diameter portion.

12. The apparatus of claim 11, wherein the first driving means moves the at least one roller gradually close to each forming target axis, in accordance with a plurality of spinning cycles, and the second driving means rotates the at least one roller about the main axis relative to the workpiece every spinning cycle.

13. The apparatus of claim 11, wherein the first driving means moves at least one of the workpiece and the at least one roller relative to each other, to move the at least one roller radially toward each forming target axis, with the at least one roller being in substantial contact with the surface of the portion to be processed, and the second driving means rotates at least one of the workpiece and the at least one roller relative to each other about each forming target axis, to form the portion to be processed into the final target changed diameter portion.

14. The apparatus of claim 13, wherein the first driving means moves at least one of the workpiece and the at least one roller relative to each other, to move the central axis of portion to be processed and each forming target axis gradually close to each other in accordance with a plurality of cycles, and the second driving means rotates the at least one roller about the main axis relative to the workpiece every spinning cycle.

15. The apparatus of claim 11, further comprising; means for rotating the workpiece about a perpendicular axis thereto, after one end portion of the workpiece was processed to form the final target processed portion, to support the workpiece so that the other one end portion of the workpiece is processed by the at least one roller.

16. The apparatus of claim 15, further comprising; means for holding the workpiece, after the one end portion of the workpiece was processed to form the final target processed portion, and rotating the workpiece about a central axis of the unprocessed portion to position the other one end portion of the workpiece in a predetermined relationship with the one end portion of the workpiece.

17. The apparatus of claim 11, further comprising; at least one trimming member mounted on the at least one roller for trimming the formed portion of the workpiece.

18. The apparatus of claim 17, wherein the at least one trimming member is a circular cutting element having a smaller diameter than the diameter of the at least one roller.

19. The apparatus of claim 11, wherein the second driving means includes three rollers moved radially toward the main axis, and rotated about the main axis.

20. The apparatus of claim 11, wherein the changed diameter portion is formed to provide a tapered portion, with the diameter of the workpiece gradually changed from an unprocessed portion of the workpiece.

21. The apparatus of claim 19, the changed diameter portion is formed to provide the tapered portion and a neck portion of a tubular configuration extending from the tapered portion.

* * * * *